US011578479B2

(12) United States Patent
Gochko et al.

(10) Patent No.: US 11,578,479 B2
(45) Date of Patent: Feb. 14, 2023

(54) ADJUSTABLE HEIGHT TOILET

(71) Applicant: Entijs Canada Inc., North York (CA)

(72) Inventors: Ivan Gochko, Toronto (CA); Vitaly Chornyy, Pombal (PT); Vitalia Smirnova, Toronto (CA); Vancho Stoev, Strumica (MK)

(73) Assignee: Entijs Canada Inc., North York (CA)

( * ) Notice: Subject to any disclaimer, the term of this patent is extended or adjusted under 35 U.S.C. 154(b) by 0 days.

(21) Appl. No.: 16/409,168

(22) Filed: May 10, 2019

(65) Prior Publication Data

US 2020/0102731 A1 Apr. 2, 2020

Related U.S. Application Data

(63) Continuation of application No. PCT/CA2017/051346, filed on Nov. 10, 2017.

(60) Provisional application No. 62/420,334, filed on Nov. 10, 2016.

(51) Int. Cl.

| | |
|---|---|
| ***E03D 11/12*** | (2006.01) |
| ***E03D 11/04*** | (2006.01) |
| ***A47K 13/28*** | (2006.01) |
| ***A47K 13/30*** | (2006.01) |

(52) U.S. Cl.

CPC ..... *E03D 11/125* (2013.01); *A47K 13/28* (2013.01); *A47K 13/302* (2013.01); *E03D 11/04* (2013.01)

(58) Field of Classification Search

CPC .... A47K 13/302; A47K 13/28; A47K 13/307; A47K 17/02; A47K 17/28; A47K 17/026; E03D 11/125; E03D 11/04; E03D 11/12; E03D 5/01; E03D 5/02; E03D 11/143; E03D 11/135; E03F 1/006; E03F 1/007

See application file for complete search history.

(56) References Cited

U.S. PATENT DOCUMENTS

| | | | | |
|---|---|---|---|---|
| 3,599,246 A * | 8/1971 | Bramati | ..... | A47K 13/302 4/233 |
| 4,063,316 A | 12/1977 | Hunninghaus | | |
| 4,441,218 A * | 4/1984 | Trybom | ..... | E03C 1/324 4/252.2 |
| 5,199,113 A * | 4/1993 | Glasow | ..... | E03C 1/324 192/129 R |

(Continued)

FOREIGN PATENT DOCUMENTS

| | | | | |
|---|---|---|---|---|
| CN | 101353902 A | 1/2009 | | |
| FR | 2480825 A1 * | 10/1981 | ..... | E03D 11/125 |

(Continued)

OTHER PUBLICATIONS

International Search Report and Written Opinion, dated Feb. 9, 2018, for International Application No. PCT/CA2017/051346.

*Primary Examiner* — Erin Deery
(74) *Attorney, Agent, or Firm* — Bereskin & Parr LLP

(57) ABSTRACT

An adjustable height toilet has a frame, a bowl assembly, and at least one bowl assembly actuator. The at least one bowl assembly actuator is configured to translate the bowl assembly vertically with respect to the frame between a lower position and an upper position. The toilet may include one or more of the following features: automatically deployable handles; a tilting bowl assembly; a rotational base assembly; a seat cleaner; a vacuum flush system; a retractable bidet; a slideable electrical coupling; and a motorized toilet seat.

9 Claims, 30 Drawing Sheets

(56) References Cited

U.S. PATENT DOCUMENTS

| | | | | |
|---|---|---|---|---|
| 5,271,105 | A * | 12/1993 | Tyler | E03D 11/10 251/63 |
| D358,201 | S | 5/1995 | Werner et al. | |
| 6,496,989 | B1 * | 12/2002 | Meiser | E03D 11/025 4/252.1 |
| D533,261 | S | 12/2006 | Mukai | |
| D614,751 | S | 4/2010 | Ogawa | |
| 7,987,529 | B1 | 8/2011 | Wise | |
| 8,239,973 | B1 * | 8/2012 | Character | A47K 13/307 4/217 |
| 8,291,525 | B2 | 10/2012 | Pondelick et al. | |
| 8,800,074 | B2 | 8/2014 | Rodgers et al. | |
| 2011/0113540 | A1 | 5/2011 | Plate et al. | |
| 2015/0308091 | A1 | 10/2015 | Foust et al. | |
| 2018/0338652 | A1 | 11/2018 | Erkelens | |
| 2020/0205688 | A1 | 7/2020 | Hall et al. | |
| 2021/0246645 | A1 | 8/2021 | Rodgers | |

FOREIGN PATENT DOCUMENTS

| | | | | | |
|---|---|---|---|---|---|
| FR | 2809124 | A1 * | 11/2001 | | E03D 11/12 |
| KR | 100663754 | B1 * | 1/2007 | | |
| KR | 20090076869 | A * | 7/2009 | | |
| KR | 101140280 | B1 * | 5/2012 | | |
| WO | WO-9218713 | A1 * | 10/1992 | | E03F 1/006 |
| WO | 2010039567 | A1 | 4/2010 | | |
| WO | WO-2015155304 | A1 * | 10/2015 | | B63B 29/14 |
| WO | 2018085939 | A1 | 5/2018 | | |

* cited by examiner

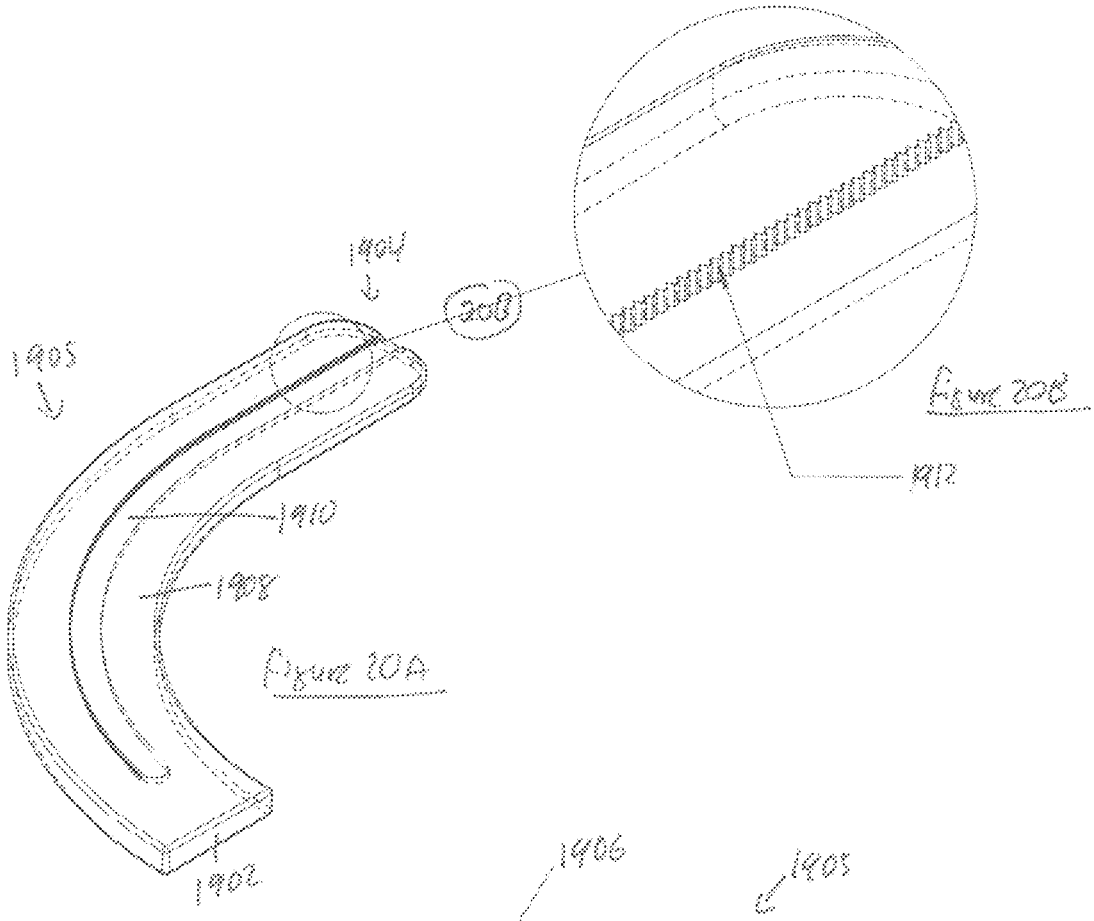
Figure 20B
Figure 20A
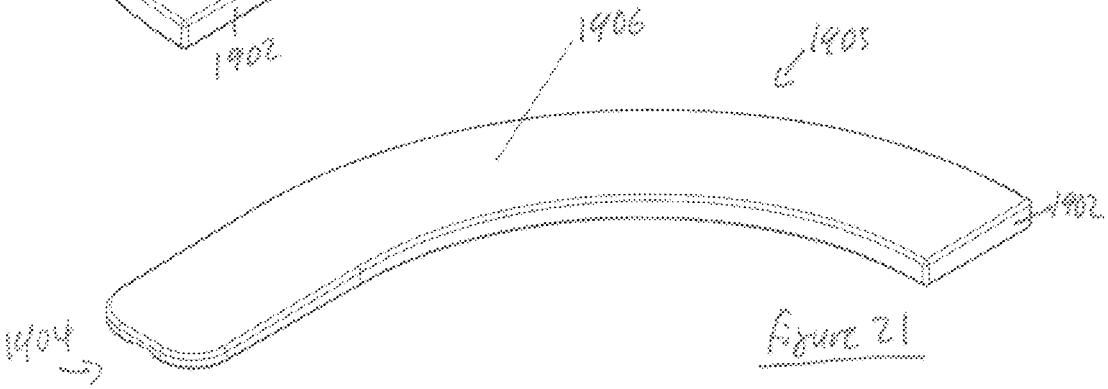
Figure 21

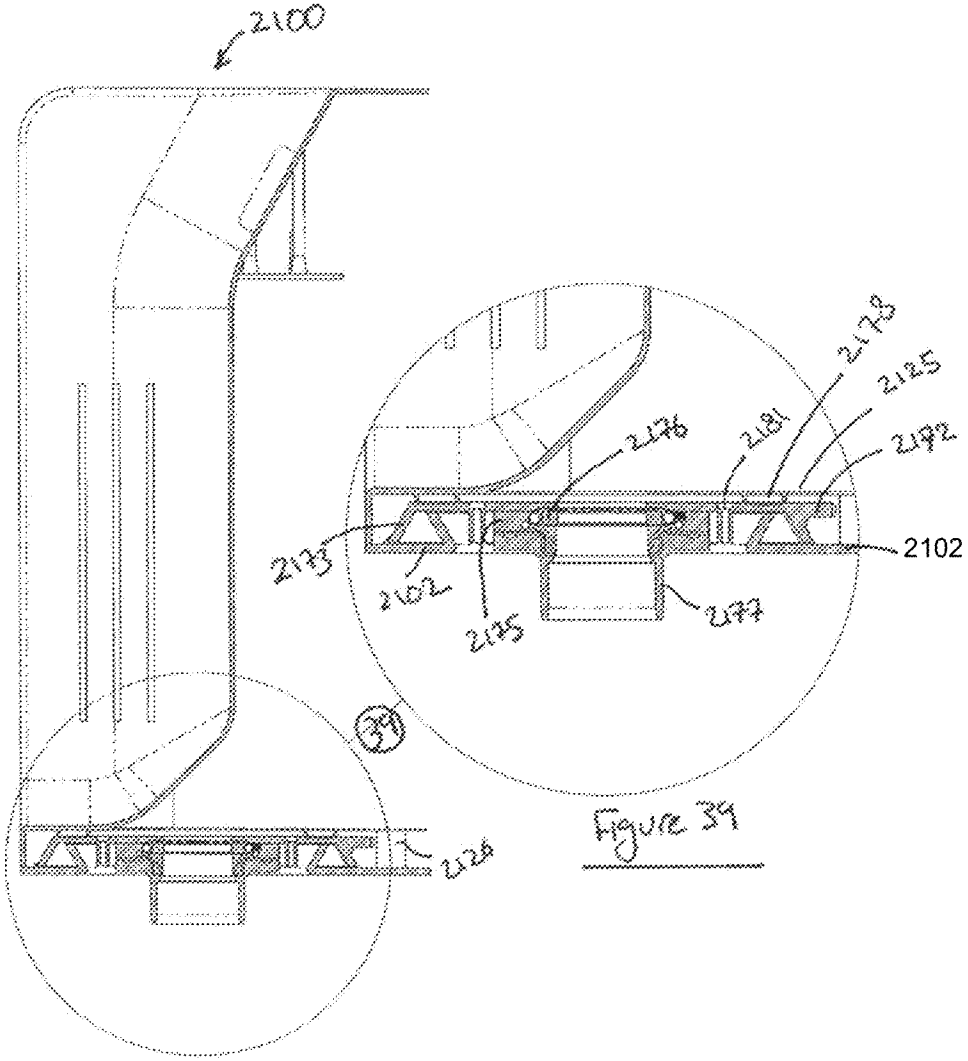
2100
2102
2142
2145
2146
2147
2148
2149
2150
2151
2152
2153
2154
2155
2156
2157
2158
2159
2160
2161
2162
2163
2164
2165
2166
2167
2168
2169
2170
2171
2172
2173
2174
2175
2176
2177
2178
2179
2180
2181
2182
2183
2184

ADJUSTABLE HEIGHT TOILET

CROSS-REFERENCE TO RELATED APPLICATIONS

This application is a continuation of PCT Application No. PCT/CA2017/051346 filed on Nov. 10, 2017, which claims the benefit of U.S. Provisional Application No. 62/420,334 filed on Nov. 10, 2016, the disclosures of which are incorporated herein by reference.

FIELD

This disclosure relates generally to toilets, and more specifically to adjustable height toilets and features that may be useful in adjustable height toilets.

INTRODUCTION

Toilets are well known. Adjustable height toilets are less common, but may have one or more advantages over fixed height toilets. For example, persons with limited mobility may adjust the height of the toilet seat to accommodate their range of motion. Also, different users of a variable height toilet may each adjust the height of the toilet seat to their preferred height. For example, in a residential application, taller individuals may prefer a higher toilet seat, while shorter individuals (e.g. children) may prefer a lower toilet seat.

Rodgers et al. (U.S. Pat. No. 8,800,074) disclose an adjustable toilet seat lift adapted to selectively raise and lower a toilet. In the described examples, a tank housing including a water tank is raised and lowered.

Glasow et al. (U.S. Pat. No. 5,199,113) disclose a toilet elevation adjusting apparatus having an inner box-shaped frame secured within an outer box-shaped frame by channels and wheels to allow vertical displacement of the inner frame while the outer frame is secured to a wall. A toilet is secured to the inner frame to translate with it.

SUMMARY

The following introduction is provided to introduce the reader to the more detailed discussion to follow. The introduction is not intended to limit or define any claimed or as yet unclaimed invention. One or more inventions may reside in any combination or sub-combination of the elements or process steps disclosed in any part of this document including its claims and figures.

Research has suggested that there may be one or more advantages of defecating while in a squatting position as compared with defecating while in a sitting position. For example, one study found that volunteers reported that the time needed for sensation of satisfactory bowel emptying was reduced in a squatting position, as compared with sitting positions on both a standard height toilet seat and a lower than standard height toilet seat. The study volunteers also reported that the degree of subjectively assessed straining was reduced when squatting as compared to both sitting positions.

While persons may desire to assume a squatting position while defecating, persons with limited mobility (e.g. the elderly, overweight persons, persons with disabilities) may experience difficulty lowering themselves into a squatting position, maintain their balance while in a squatting position, and/or raising themselves from a squatting position to a standing position.

An adjustable height toilet has a seat or surface for on which a user may sit while defecating or urinating. The seat may be selectively raised and lowered to provide a desired position for a user. For example, the seat may initially be in a raised position, and once a user has sat on the seat it may be lowered to promote a squatting or semi-squatting posture, and returned to the raised position once a user has finished defecating.

In accordance with this broad aspect, there is provided an adjustable height toilet comprising: a frame; a bowl assembly; and at least one bowl assembly actuator; wherein the at least one bowl assembly actuator is configured to translate the bowl assembly vertically with respect to the frame between a lower position and an upper position.

In some embodiments, the adjustable height toilet further comprises one or more handles coupled to the frame and moveable between a retracted position and a deployed position, wherein when the bowl assembly is raised to the upper position, the handles are automatically moved to the deployed position.

In some embodiments, the one or more handles are pivotally coupled to the frame, and wherein when the handles are in the retracted position and the bowl assembly is raised to the upper position, the handles are automatically moved to the deployed position.

In some embodiments, the adjustable height toilet further comprises one or more handle actuators, and wherein the one or more handles are automatically extended forwardly from the frame to the deployed position by the one or more handle actuators when the bowl assembly is raised to the upper position.

In some embodiments, the bowl assembly is configured to pivot relative to the frame between a level orientation and a forwardly inclined orientation when the bowl assembly is in the upper position.

In some embodiments, the bowl assembly is further configured to pivot relative to the frame between the level orientation and the forwardly inclined orientation when the bowl assembly is in at least one of the upper position and an intermediate position between the upper position and the lower position.

In some embodiments, the adjustable height toilet further comprises a rotational base assembly for securing the frame to a floor surface, wherein the rotational base assembly is configured to rotate the frame about a generally vertical axis through a range of at least about 30 degrees.

In some embodiments, the rotational base assembly is configured to rotate the frame through a range of about 90 degrees.

In some embodiments, the bowl assembly comprises a seat portion, the seat portion having an upper surface and a plurality of fluid conduits extending between the upper surface of the seat portion and a fluid outlet.

In some embodiments, the bowl assembly further comprises a seat cleaner and a seat cleaner actuator configured to move the seat cleaner along a length of the seat portion.

In some embodiments, the seat cleaner is configured to direct at least one of steam, water, and a disinfectant fluid towards the upper surface of the seat portion.

In some embodiments, the seat cleaner comprises at least one UV light emitter configured to direct UV light towards the upper surface of the seat portion.

In some embodiments, the at least one bowl assembly actuator comprises a pair of linear actuators.

In some embodiments, the adjustable height toilet further comprises a vacuum flush system.

In some embodiments, the adjustable height toilet further comprises a retractable bidet positioned in the bowl assembly.

In some embodiments, the adjustable height toilet further comprises a pair of seat portions positioned on the bowl assembly, and at least one seat actuator for selectively translating the pair of seat portions between a deployed position and a retracted position.

It will be appreciated by a person skilled in the art that a method or apparatus disclosed herein may embody any one or more of the features contained herein and that the features may be used in any particular combination or sub-combination.

These and other aspects and features of various embodiments will be described in greater detail below.

BRIEF DESCRIPTION OF THE DRAWINGS

For a better understanding of the described embodiments and to show more clearly how they may be carried into effect, reference will now be made, by way of example, to the accompanying drawings in which:

FIG. 20A is a perspective view of the underside of a toilet seat portion;

FIG. 20B is an enlarged view of the box 20B in FIG. 20A;

FIG. 21 is a top perspective view of the toilet seat portion of FIG. 20A;

FIG. 37 is a top view of the frame of FIG. 35;

FIG. 38 is a section view of the frame of FIG. 35 taken along the line 38-38 in FIG. 37;

FIG. 39 is an enlarged view of the box 39 in FIG. 38;

Figure 1:
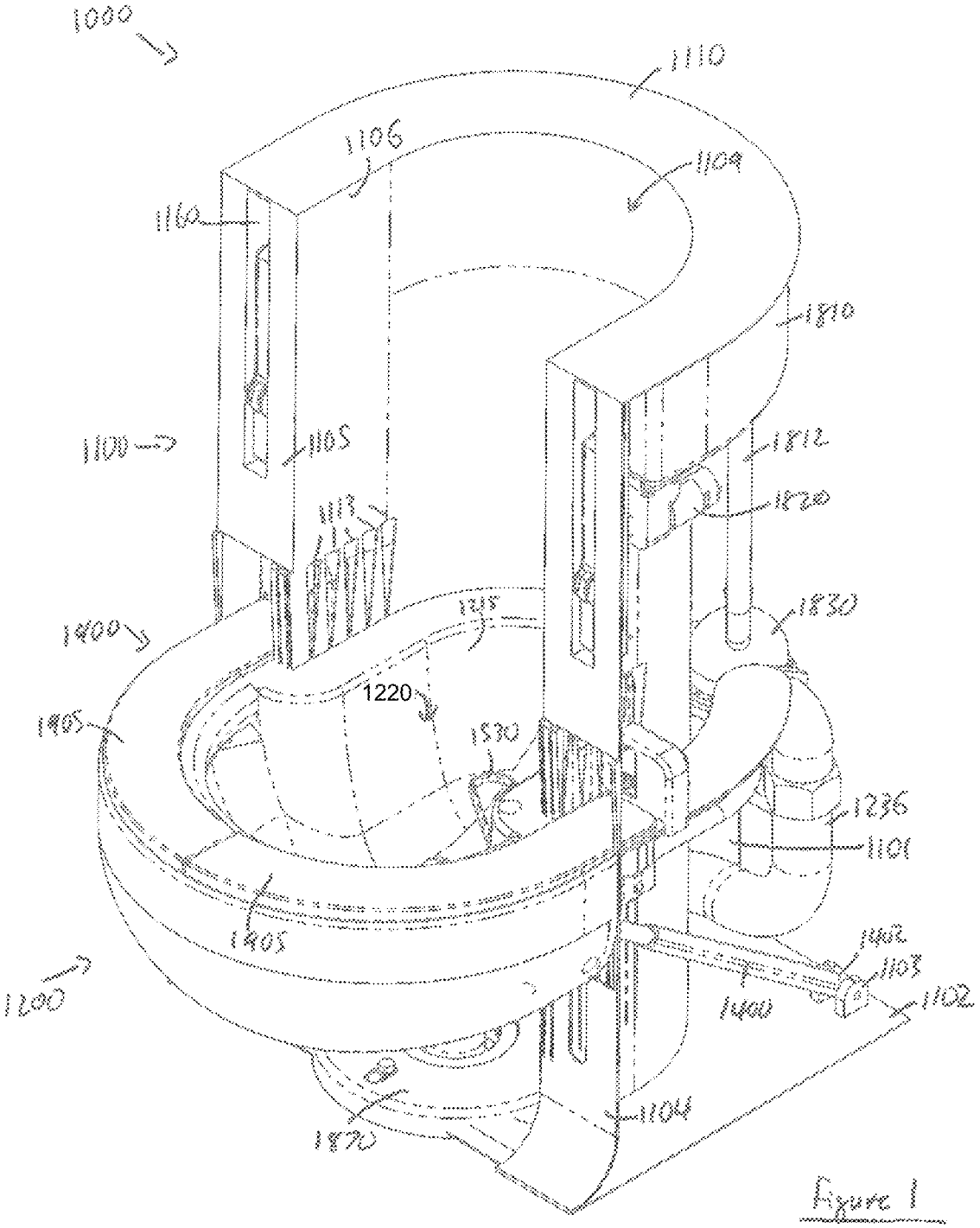
FIG. 1 is a perspective view of an adjustable height toilet according to one embodiment, with an outer covering not shown for ease of understanding.
Figure 2:
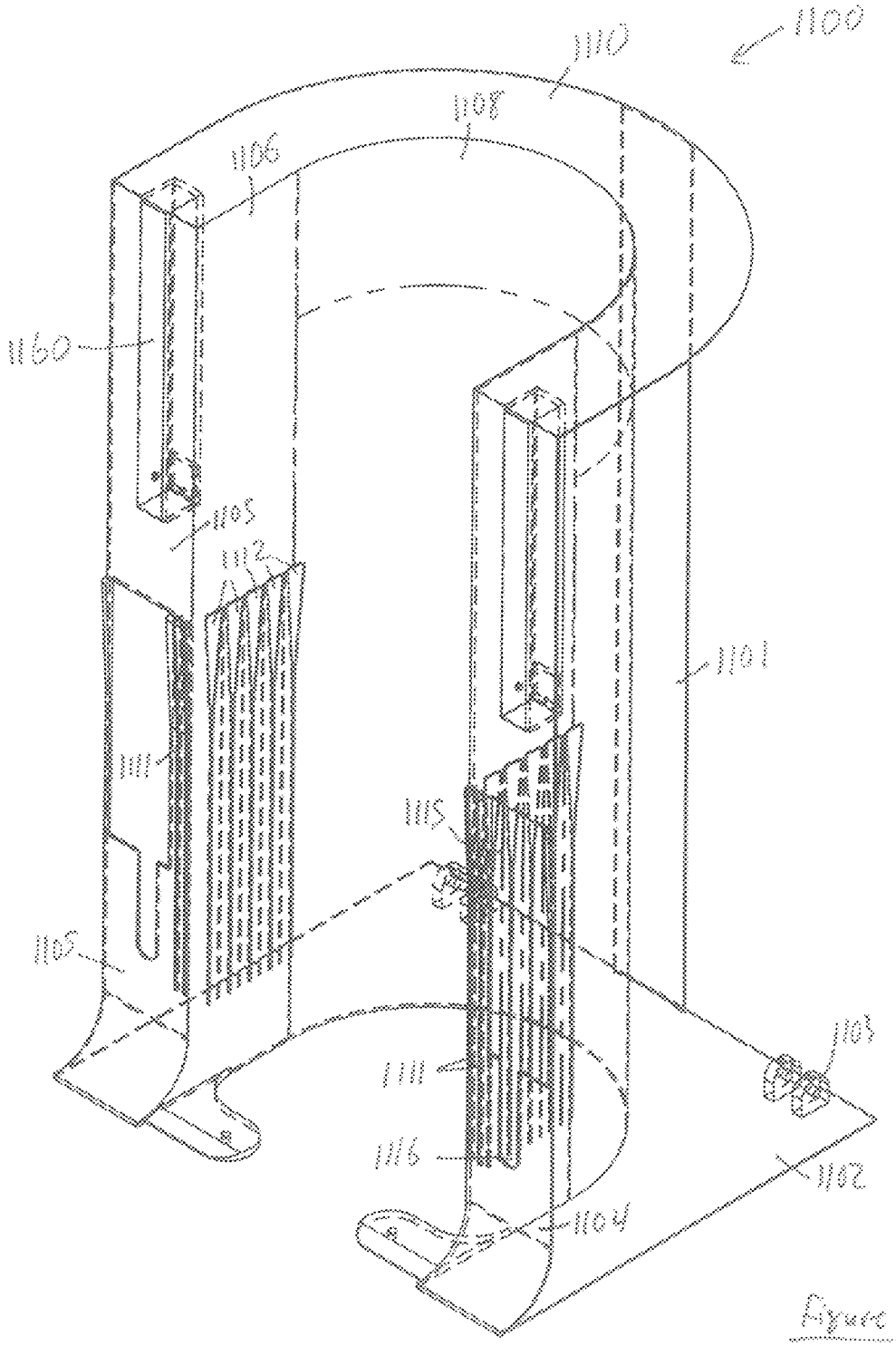
FIG. 2 is a perspective view of a frame of the adjustable height toilet of FIG. 1.

The drawings included herewith are for illustrating various examples of articles, methods, and apparatuses of the teaching of the present specification and are not intended to limit the scope of what is taught in any way.

DESCRIPTION OF EXAMPLE EMBODIMENTS

Various apparatuses, methods and compositions are described below to provide an example of an embodiment of each claimed invention. No embodiment described below limits any claimed invention and any claimed invention may cover apparatuses and methods that differ from those described below. The claimed inventions are not limited to apparatuses, methods and compositions having all of the features of any one apparatus, method or composition described below or to features common to multiple or all of the apparatuses, methods or compositions described below. It is possible that an apparatus, method or composition described below is not an embodiment of any claimed invention. Any invention disclosed in an apparatus, method or composition described below that is not claimed in this document may be the subject matter of another protective instrument, for example, a continuing patent application, and the applicant(s), inventor(s) and/or owner(s) do not intend to abandon, disclaim, or dedicate to the public any such invention by its disclosure in this document.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures, and components have not been described in detail so as not to obscure the example embodiments described herein. Also, the description is not to be considered as limiting the scope of the example embodiments described herein.

General Description of an Adjustable Height Toilet According to One Embodiment Referring to FIG. 1, an adjustable height toilet is shown generally as 1000. The adjustable height toilet 1000 includes a frame 1100 and a bowl assembly 1200 that is movably connected to the frame 1100 such that the height of the bowl assembly 1200 relative to the frame 1100 can be selectively adjusted, thereby adjusting the height of a toilet seat 1900 relative to a surface on which the frame 1100 is positioned.

Frame 1100 includes a base 1102 and a wall member 1108 extending upwardly from base 1102. Wall member 1108 has a rear portion that is generally curved about a vertical axis, and defines a recess 1109 in which a rear portion of bowl assembly 1200 is received. In the illustrated example, the recess 1109 may be characterized as generally C-shaped, although in alternative embodiments the recess may be generally U-shaped or of any other suitable shape.

As shown in FIGS. 1-5, wall member 1108 also has a front portion that defines a pair of inwardly facing surfaces 1106, 1107. A number of vertically oriented slots 1112 are provided in each surface 1106, 1107, respectively. As will be discussed further below, slots 1112 assist in guiding the bowl assembly 1200 as it travels vertically within frame 1100.

Frame 1100 also includes an upper surface 1110 extending outwardly from the top of wall member 1108, and at least one upwardly extending rear support 1101. In the illustrated example, wall member 1108 and the upper surface 1110 and upwardly extending rear support 1101 are integrally formed, although they may be formed separately in alternative embodiments.

Frame 1100 also includes a pair of upwardly extending front supports 1104, 1105. In the illustrated example, wall member 1108 and the upwardly extending front supports 1104, 1105 are integrally formed, although they may be formed separately in alternative embodiments. A number of vertically oriented slots 1111 are provided in each support 1104, 1105, respectively. As will be discussed further below, slots 1111 assist in guiding the bowl assembly 1200 as it travels vertically within frame 1100.

Frame 1100 may be made from any suitable material. Preferably, frame 1100 is made from a material that has relatively high strength and/or stiffness for a relatively thin walled construction, such as a fiber-reinforced plastic (e.g. a carbon fiber reinforced thermoplastic) and the like. In some embodiments, all or a portion of frame 1100 is made of metal, such as aluminum, stainless steel, tungsten, and the like. Preferably, an optional outer covering is provided to enclose frame 1100, e.g. as shown in FIGS. 24 to 28.

Figure 7A:
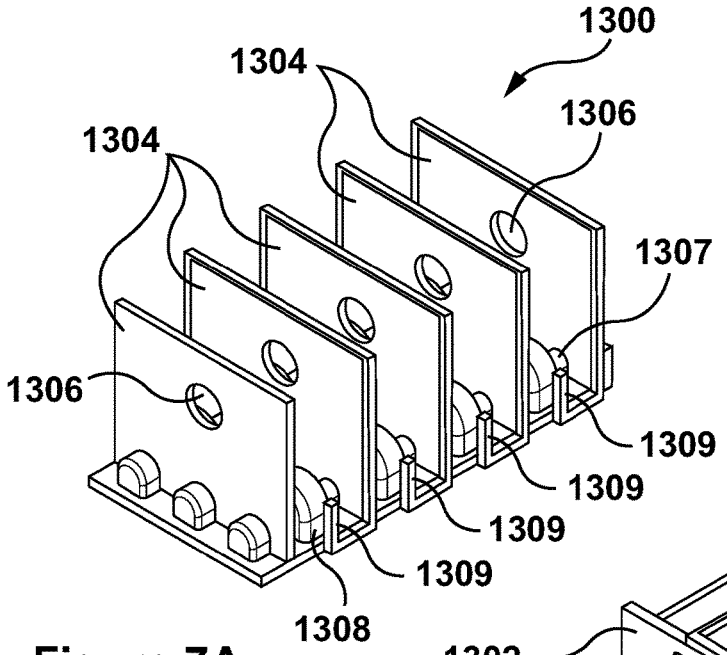
FIG. 7A is a perspective view of a side rail assembly used in the adjustable height toilet of FIG. 1.
Figure 7B:
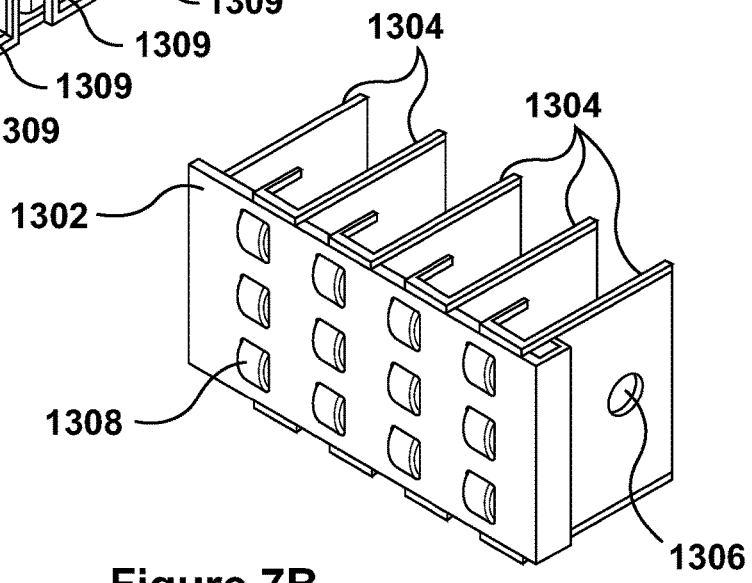
FIG. 7B is another perspective view of the side rail assembly of FIG. 7A.

Referring to FIGS. 7A and 7B, a side rail assembly is shown generally as 1300. Side rail assembly 1300 includes a base 1302 and a plurality of bowl engagement flanges 1304 extending generally perpendicularly from the base 1302. Flanges 1304 are configured to be inserted through slots 1112 of frame 1100, such that flanges 1304 can be oriented inwardly towards bowl assembly 1200. Side rail assembly 1300 also has a plurality of rollers 1308, which in the illustrated example are secured to base 1302 by a plurality of roller shafts 1307 mounted to the inner face of base 1302. When the side rail assembly 1300 is positioned with flanges 1304 inserted through slots 1112 of frame 1100, rollers 1308 are configured to bear against the outer surface of wall member 1108, providing a rolling contact surface between side rail assembly 1300 and frame 1100.

Figure 11A:
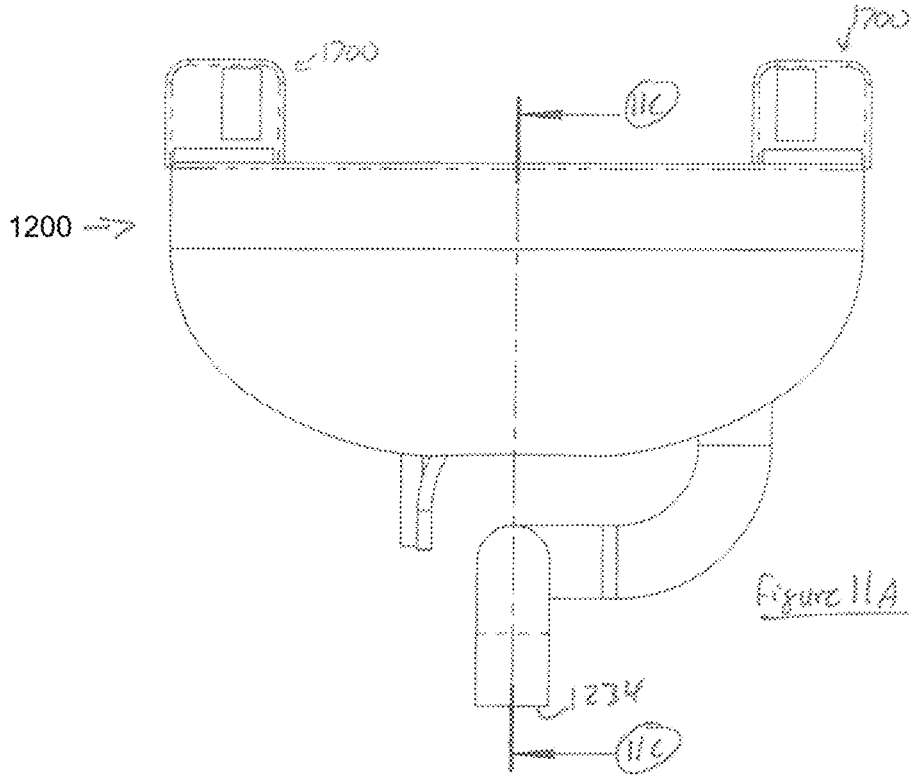
FIG. 11A is a front view of the bowl assembly of FIG. 10.
Figure 11B:
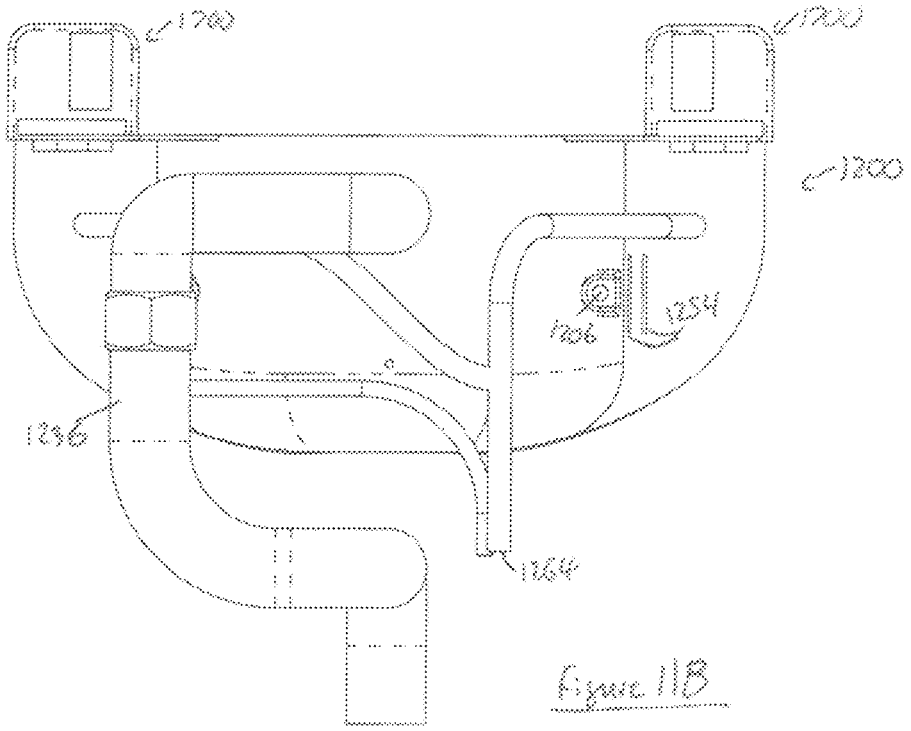
FIG. 11B is a rear view of the bowl assembly of FIG. 10.

Each flange 1304 has an aperture 1306 for use in securing the side rail assembly 1300 to the bowl assembly 1200. As shown in FIG. 11D, a plurality of recesses 1204 are provided on each side of bowl assembly 1200. Recesses 1204 are configured to receive flanges 1304 of side rail assembly 1300. As shown in FIG. 11B, a bore 1206 is provided through bowl assembly 1200. Bore 1206 is oriented generally transverse to recesses 1204, and intersects the recesses such that when flanges 1304 of side rail assembly 1300 are inserted through slots 1112 and positioned in recesses 1204, a bolt or other mechanical fastener may be positioned in bore 1206 and through apertures 1306 to secure side rail assembly 1300 to bowl assembly 1200.

Figure 8A:
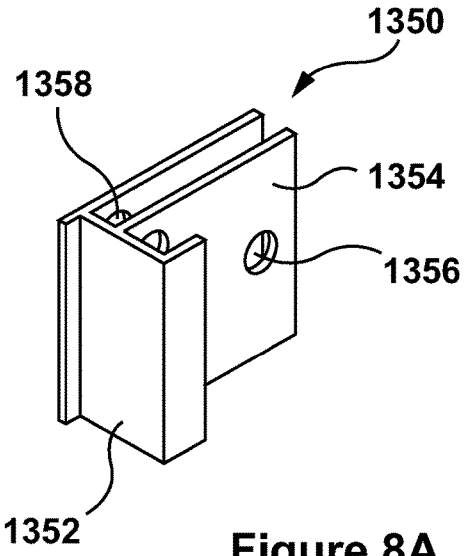
FIG. 8A is a perspective view of a front rail assembly used in the adjustable height toilet of FIG. 1.
Figure 8B:
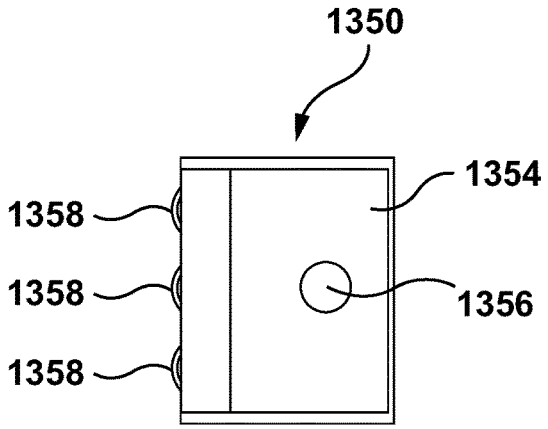
FIG. 8B is another perspective view of the front rail assembly of FIG. 8A.

Referring to FIGS. 8A and 8B, a front rail assembly is shown generally as 1350. Front rail assembly 1350 includes a base 1352 and a plurality of bowl engagement flanges 1354 extending generally perpendicularly from the base 1352. Flanges 1354 are configured to be inserted through slots 1111 of frame 1100, such that flanges 1354 can be oriented forwardly towards a rear face of bowl assembly 1200. Front rail assembly 1350 also has a plurality of rollers 1358, e.g. by a plurality of roller shafts (not shown) mounted to the inner face of base 1302. When the front rail assembly 1350 is positioned with flanges 1354 inserted through slots 1111 of frame 1100, rollers 1358 are configured to bear against the rear surface of front support 1104 or 1105, providing a rolling contact surface between front rail assembly 1350 and frame 1100.

Each flange 1354 has an aperture 1356 for use in securing the front rail assembly 1350 to the bowl assembly 1200. As shown in FIG. 11B, a plurality of recesses 1254 are provided on a rear face of bowl assembly 1200. Recesses 1254 are configured to receive flanges 1354 of front rail assembly 1350. As shown in FIG. 11D, a bore 1256 is provided through bowl assembly 1200. Bore 1256 is oriented generally transverse to recesses 1254, and intersects the recesses such that when flanges 1354 of front rail assembly 1350 are inserted through slots 1111 and positioned in recesses 1254, a bolt or other mechanical fastener may be positioned in bore 1256 and through apertures 1356 to secure front rail assembly 1350 to bowl assembly 1200.

Figure 6:
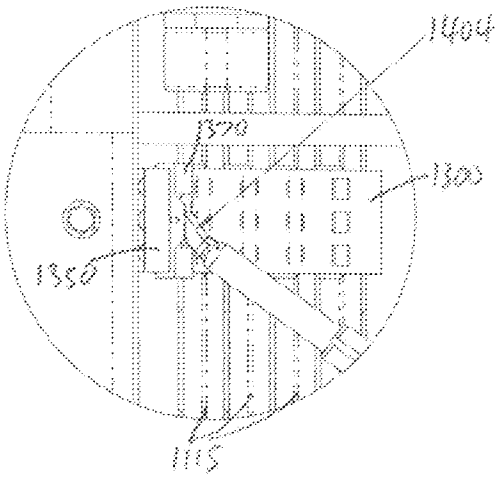
FIG. 6 is an enlarged view of the box 6 in FIG. 5.
Figure 5:
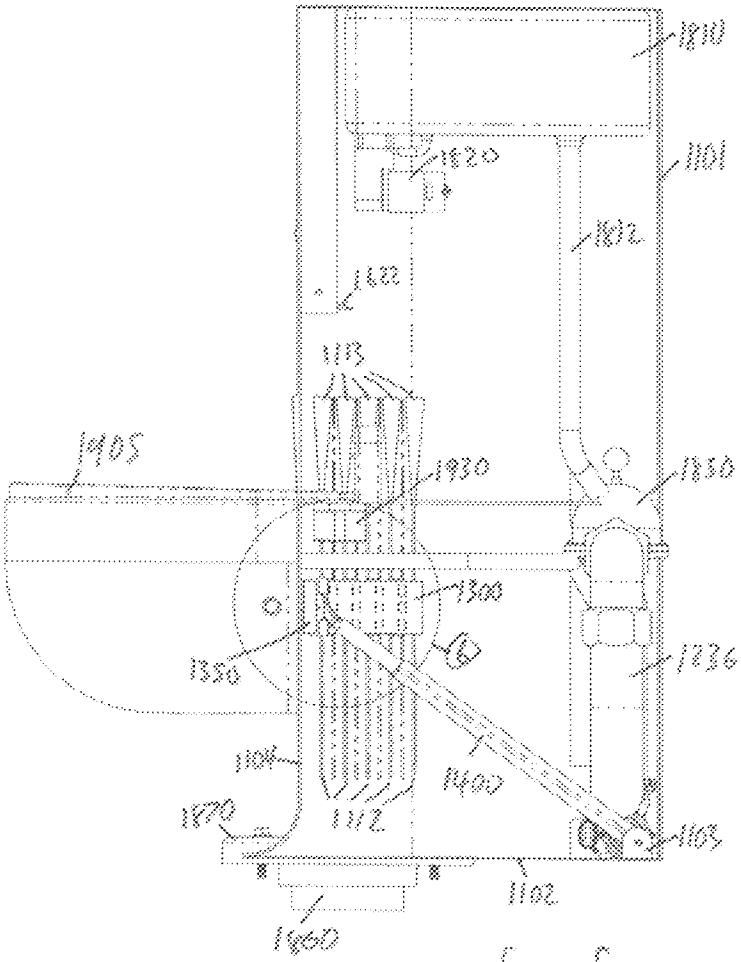
FIG. 5 is a side view of the adjustable height toilet of FIG. 1, with the bowl assembly in an intermediate position.
Figure 9A:
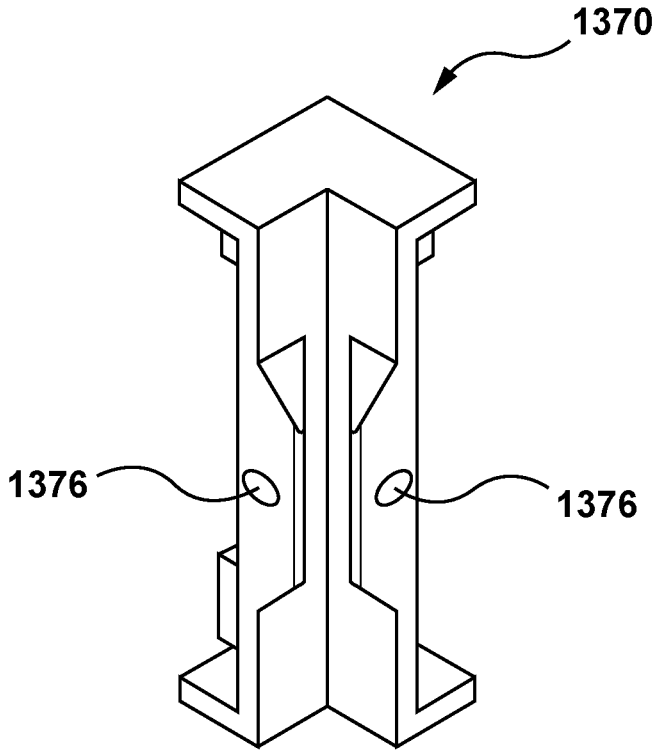
FIG. 9A is a top perspective view of an actuator fin used in the adjustable height toilet of FIG. 1.
Figure 9B:
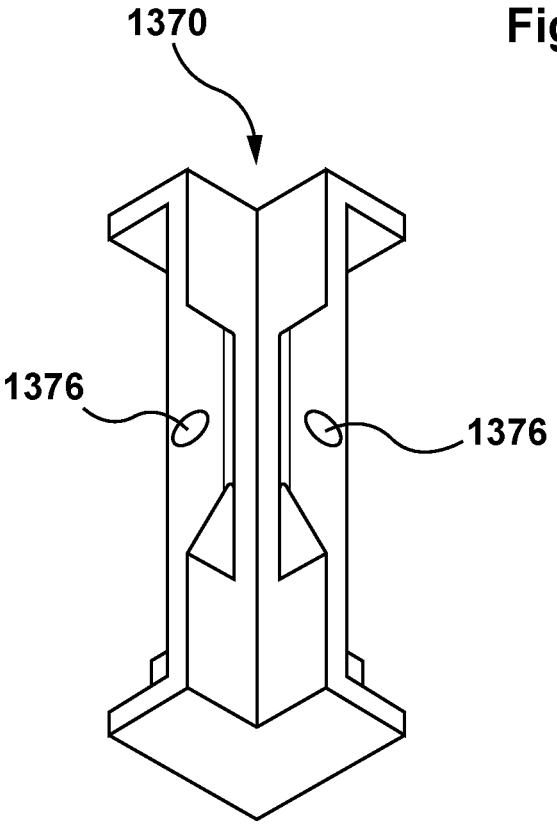
FIG. 9B is a bottom perspective view of the actuator fin of FIG. 9A.
Figure 9C:
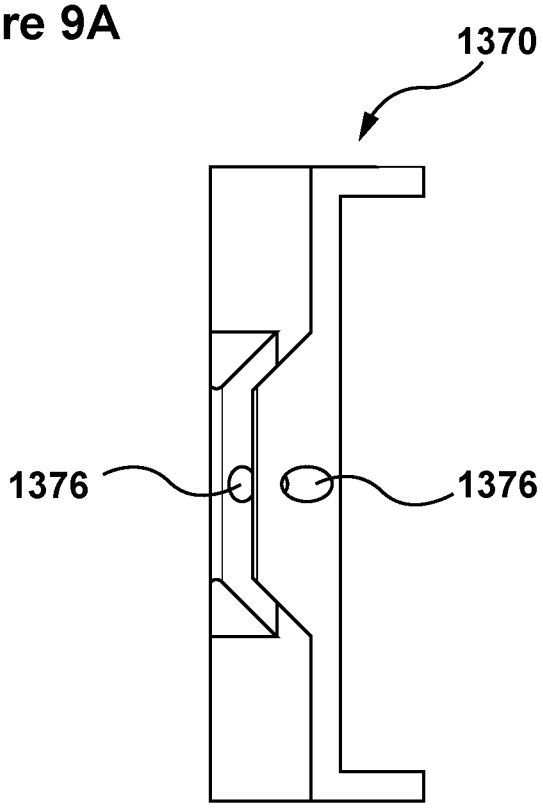
FIG. 9C is a side view of the actuator fin of FIG. 9A.

Referring to FIGS. 1, 5, and 6, an actuator, referred to generally as 1400, is provided to raise and/or lower bowl assembly 1200 relative to frame 1100. A first end 1402 of the actuator is pivotally secured to base 1102. In the illustrated example, mounting flanges 1103 are provided to pivotally secure actuator 1400 to frame 1100, but in other embodiments alternative mounting arrangements could be used. A second end 1404 of the actuator is pivotally secured to one or both of front rail assembly 1350 and side rail assembly 1300. For example, referring to FIGS. 9A to 9C, an actuator fin, shown generally as 1370, is preferably provided. As perhaps best seen in FIG. 6, an actuator fin 1370 may be secured to both a front rail assembly 1350 and a side rail assembly 1300, and provide one or more common attachment points 1376 for second end 1404 of actuator 1400.

Figure 18:
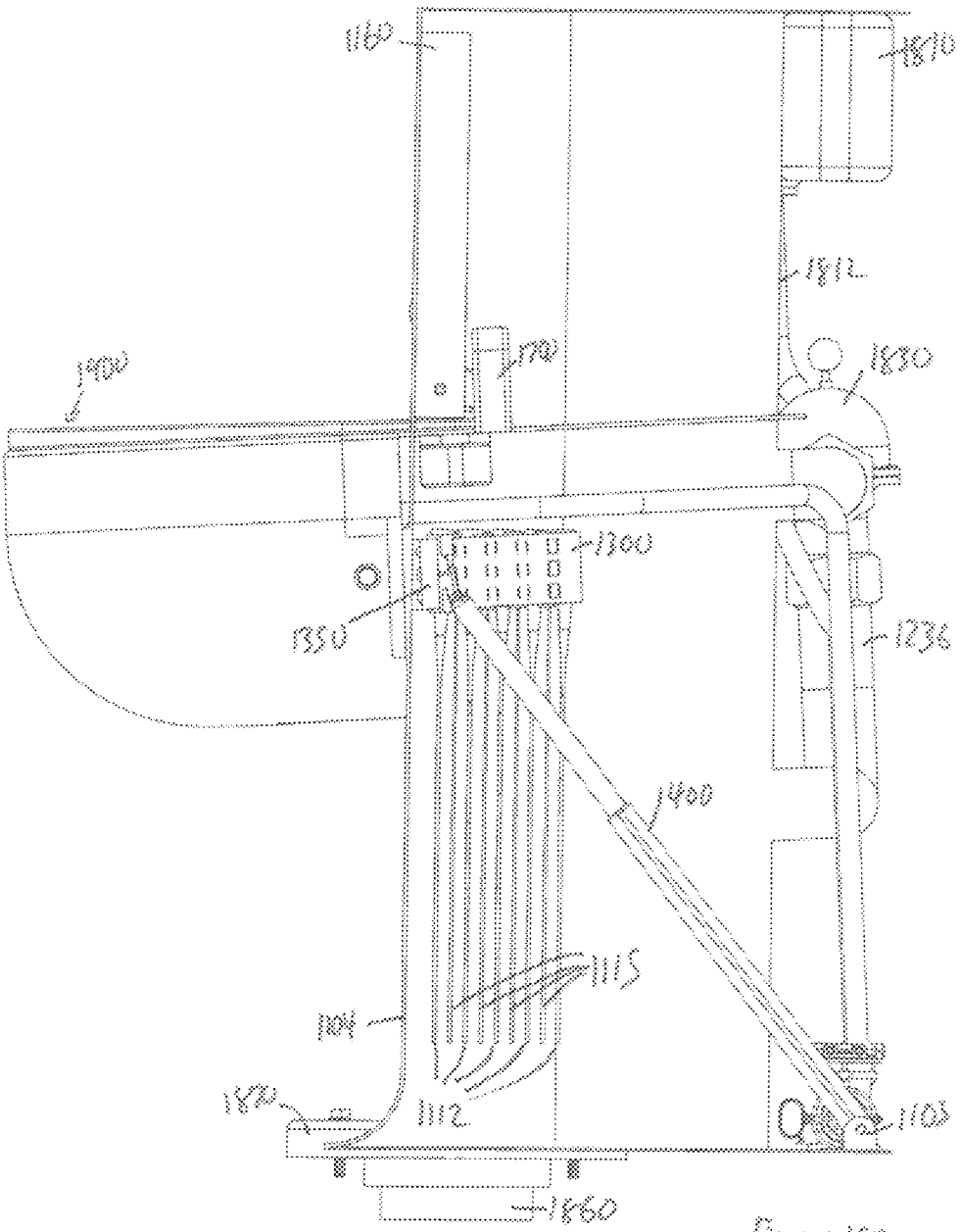
FIG. 18 is a side view of the adjustable height toilet of FIG. 1, with the bowl assembly in a raised position and in a tilted orientation.
Figure 19:
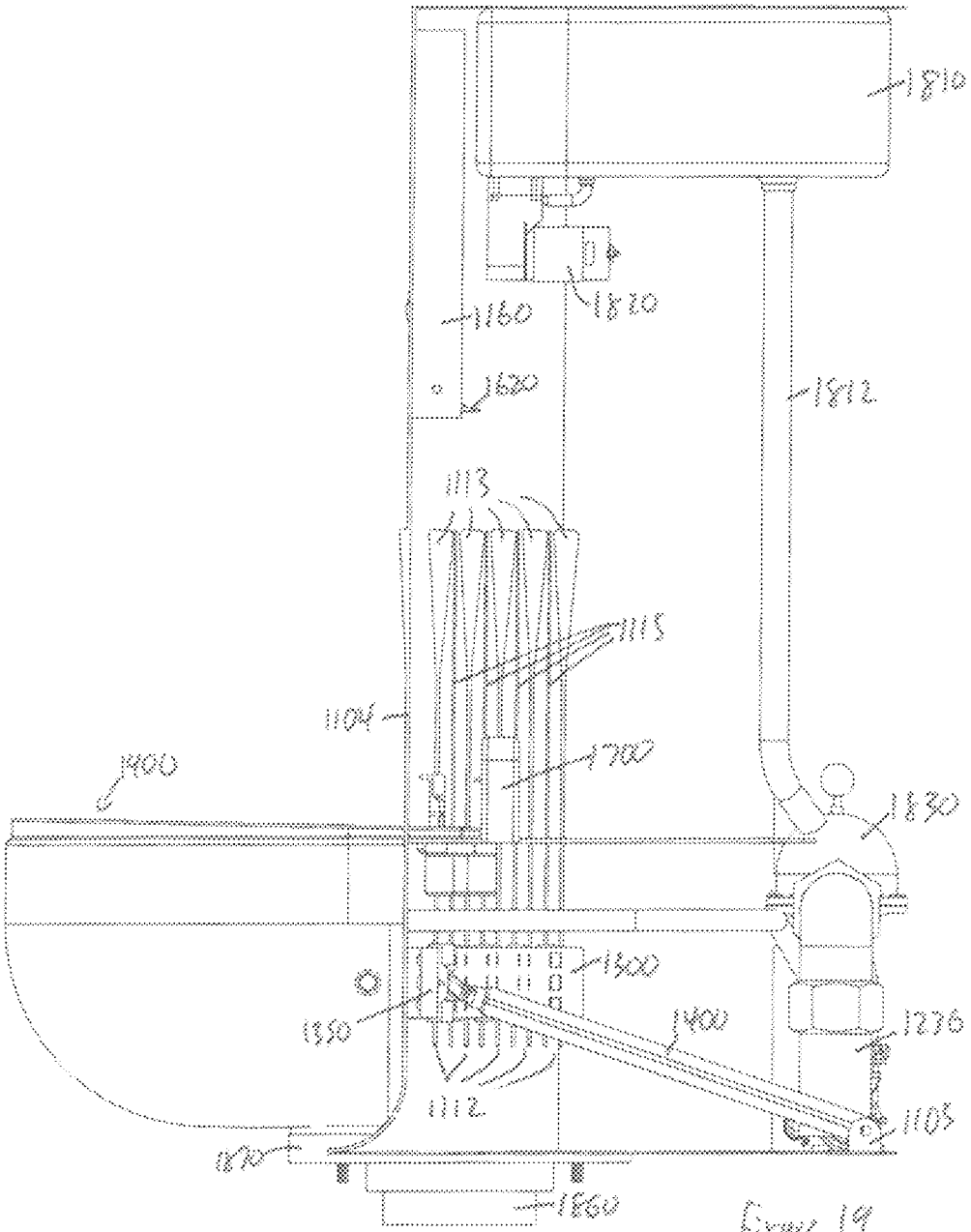
FIG. 19 is a side view of the adjustable height toilet of FIG. 1, with the bowl assembly in a lowered position.

Actuator 1400 is preferably a linear actuator, such as an electric rotating actuator, a ball screw, a worm drive driven by an electric motor, a hydraulic cylinder, a pneumatic cylinder, of other suitable actuator for imparting a linear force between the first end 1402 (coupled to frame 1100) and the second end 1404 (coupled to one or both of rail assemblies 1300, 1350). In this arrangement, as actuator 1400 is extended, rail assemblies 1300, 1350 (and thus bowl assembly 1200) will be displaced upwards (e.g. vertically), guided by slots 1111, 1112, away from base 1102 of frame 1100, thereby raising bowl assembly 1200. FIG. 18 illustrates adjustable height toilet 1000 with bowl assembly 1200 in a raised position. In FIG. 18, bowl assembly 1200 is shown in a tilted orientation, as will be discussed further below. Also, when actuator 1400 is retracted, rail assemblies 1300, 1350 will be displaced downwards (e.g. vertically), towards base 1102 of frame 1100, thereby lowering bowl assembly 1200. FIG. 19 illustrates adjustable height toilet 1000 with bowl assembly 1200 in a lowered position.

Figure 10:
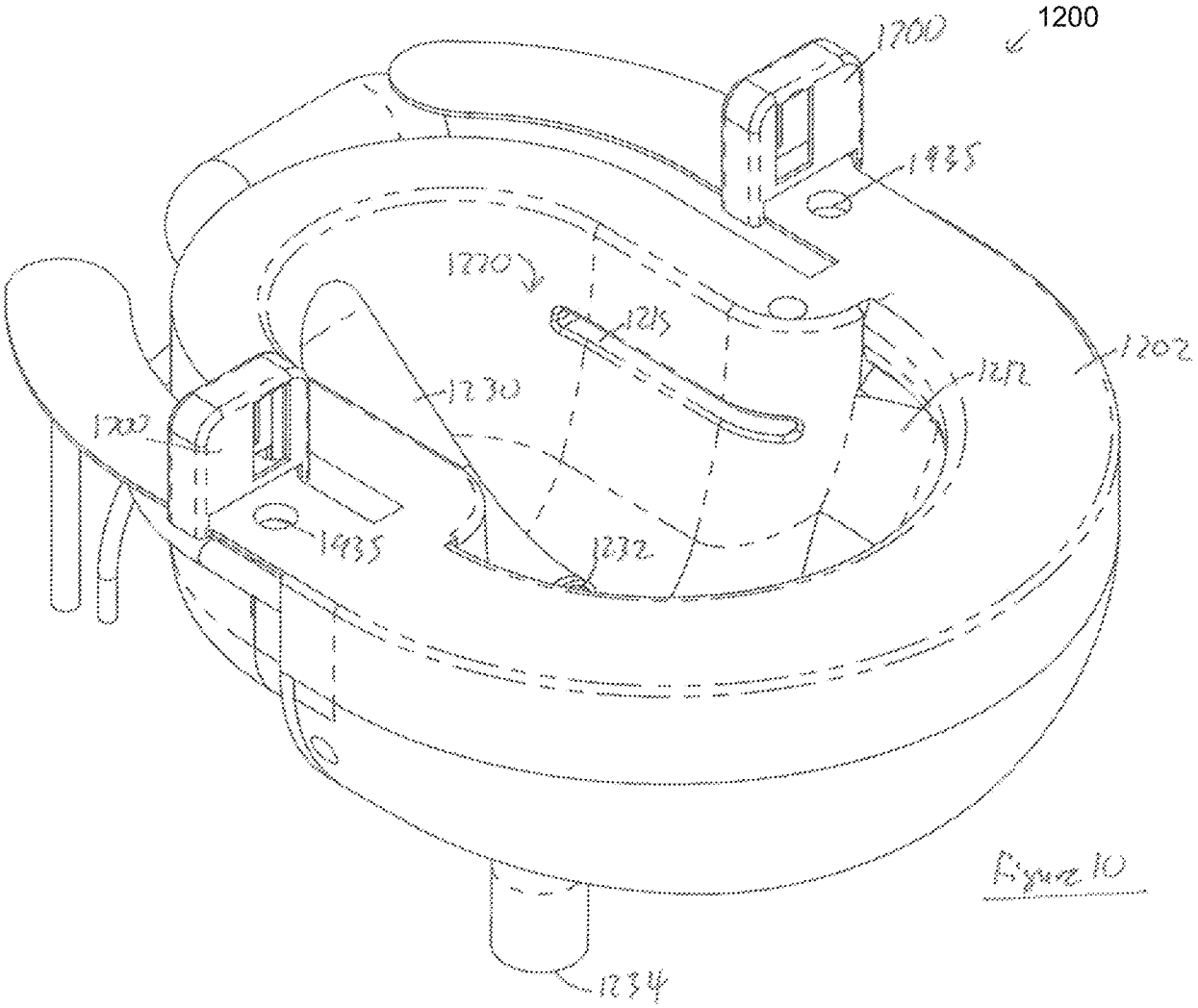
FIG. 10 is a perspective view of a bowl assembly of the adjustable height toilet of FIG. 1.

Turning to FIGS. 10 to 11D, bowl assembly 1200 includes an interior sidewall 1212 defining a central depression or bowl 1220, and a generally planar upper surface 1202 on a front portion of the bowl assembly for supporting a toilet seat 1210 (see FIG. 1).

Figure 11C:
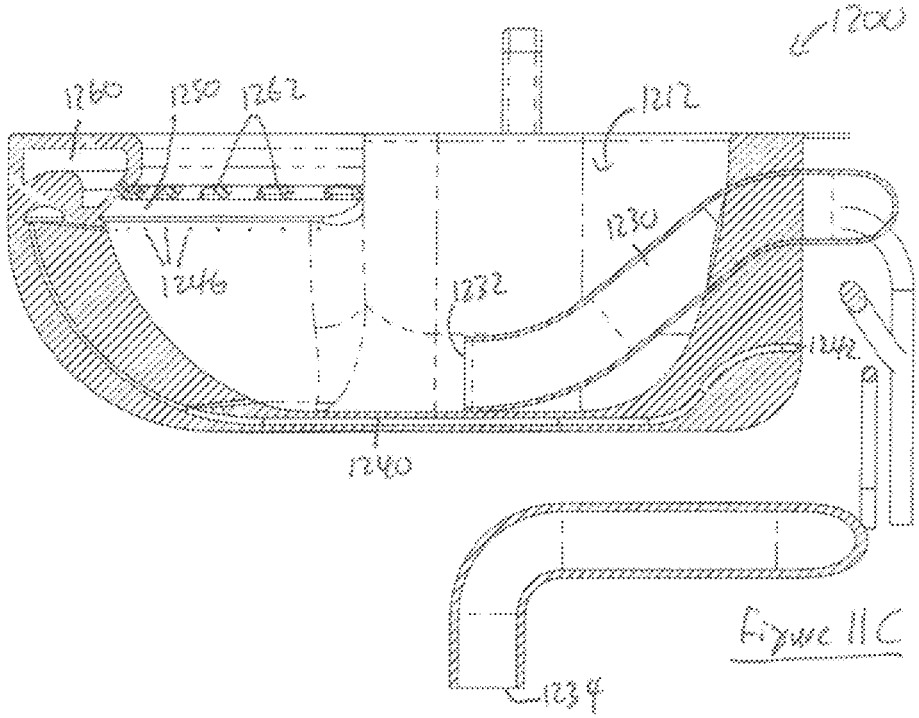
FIG. 11C is a section view of the bowl assembly of FIG. 10, taken along the line 11C-11C in FIG. 11A.
Figure 11D:
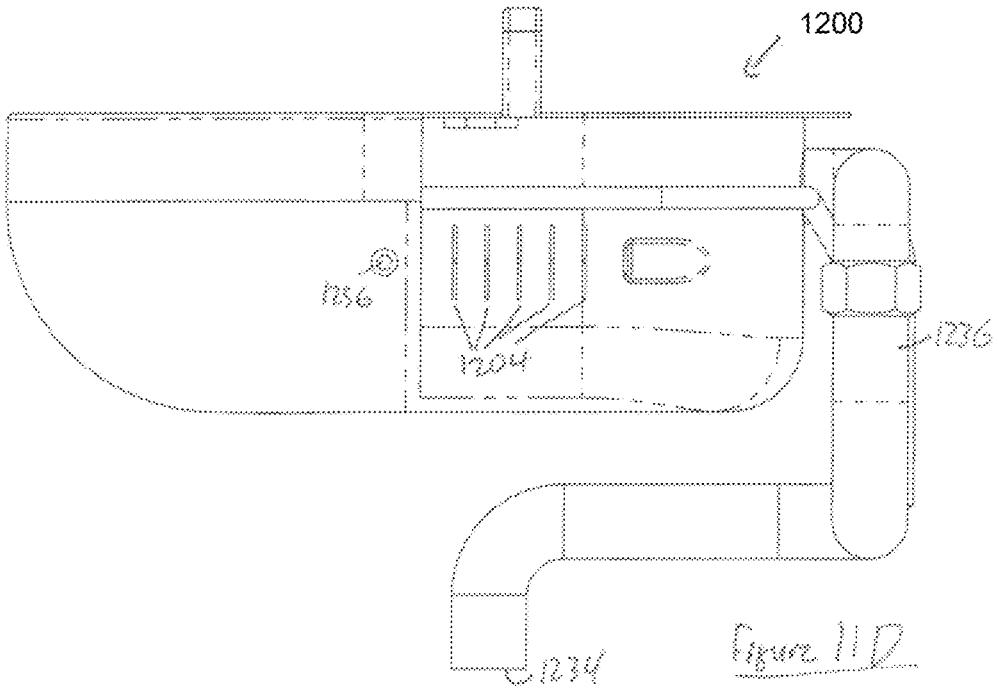
FIG. 11D is a side view of the bowl assembly of FIG. 10.

As perhaps best seen in FIG. 11C, bowl assembly includes a waste conduit 1230 for evacuating the contents of bowl 1220. Waste conduit 1230 has an inlet end 1232 positioned in the lower portion of bowl 1220, and an outlet end 1234 for installation in fluid communication with the plumbing system to which the toilet 1000 is to be installed.

To accommodate vertical movement of bowl assembly 1200 relative to frame 1100, an intermediate portion 1236 of waste conduit 1230 is configured to be extended and contracted in a vertical direction. For example, intermediate portion 1236 may include one or more telescopic conduit sections. Additionally, or alternatively, an intermediate portion 1236 may be made from a flexible or elastic material (e.g. fiber reinforced rubber, with an optional smooth plastic coating), such that that portion of waste conduit 1230 may stretch, deflect, or otherwise accommodate vertical movement of bowl assembly 1200.

Bowl assembly 1200 also includes a water conduit 1240 for introducing water or other liquids to bowl 1220. Water conduit 1240 has an inlet end 1242 positioned at the rear of bowl assembly 1200, and a plurality of nozzles or outlets 1246 positioned about an upper perimeter of bowl 1220. Accordingly, water or other liquids may be selectively introduced into bowl 1220 by providing water to inlet 1242 under sufficient pressure to flow through conduit 1240 and outlets 1246.

Preferably, a vacuum system is provided to assist in evacuating the contents of bowl 1220. Such a vacuum system may operate similarly to an aircraft lavatory, or to other vacuum assisted flushing systems known in the art.

In the illustrated example, a vacuum reservoir 1810 is in fluid communication with vacuum control valve 1830 via vacuum conduit 1812. A vacuum pump 1820 coupled to vacuum reservoir 1810 and is configured to maintain a desired vacuum pressure (i.e. a pressure below local atmospheric pressure) in vacuum reservoir 1810.

To accommodate vertical movement of bowl assembly 1200 relative to frame 1100, some or all of conduit 1812 is configured to be extended and contracted in a vertical direction. For example, conduit 1812 may include one or more telescopic conduit sections. Additionally, or alternatively, conduit 1812 may be made from a flexible or elastic material (e.g. e.g. fiber reinforced rubber, with an optional smooth plastic coating), such that that at least a portion of conduit 1812 may stretch, deflect, or otherwise accommodate vertical movement of bowl assembly 1200.

When a flush cycle is initiated, vacuum control valve 1830 is configured to selectively bring vacuum conduit 1812 into fluid communication with waste conduit 1230 at a location upstream of inlet end 1232, resulting in reduced air pressure at inlet 1232. This reduced inlet pressure assists in drawing the contents of bowl 1220 into inlet 1232 and along at least a portion of waste conduit 1230. Subsequently, the material being evacuated from bowl 1220 continues along waste conduit 1230 to outlet end 1234 due to gravity and/or momentum of the material being evacuated.

Turning to FIG. 11C, bowl assembly 1200 also optionally includes one or more recesses 1250 for accommodating light emitting devices. For example, one or more Ultraviolet (UV) light emitters may be provided to assist in disinfection of the surface of interior sidewall 1212.

Bowl assembly 1200 also optionally includes an airflow system for assisting in the removal of odorous particles from bowl 1220. In the illustrated example, the airflow system includes an air conduit 1260 that has a plurality of inlet nozzles 1262 positioned about an upper perimeter of bowl 1220 in fluid communication with one or more outlets 1264 located at the rear of bowl assembly 1200. Accordingly, air and any airborne odorous particles may be selectively removed from bowl 1220 by selectively reducing the air pressure (i.e. below atmospheric) at outlet(s) 1264, drawing air and odorous particles into inlet nozzles 1262 and through air conduit 1260 where they may be subsequently filtered or otherwise neutralized or exhausted e.g. into a waste pipe. If the air and odorous particles drawn through air conduit 1260 are exhausted into e.g. a waste pipe, a check valve may be provided to prevent reverse flow.

Figure 22:
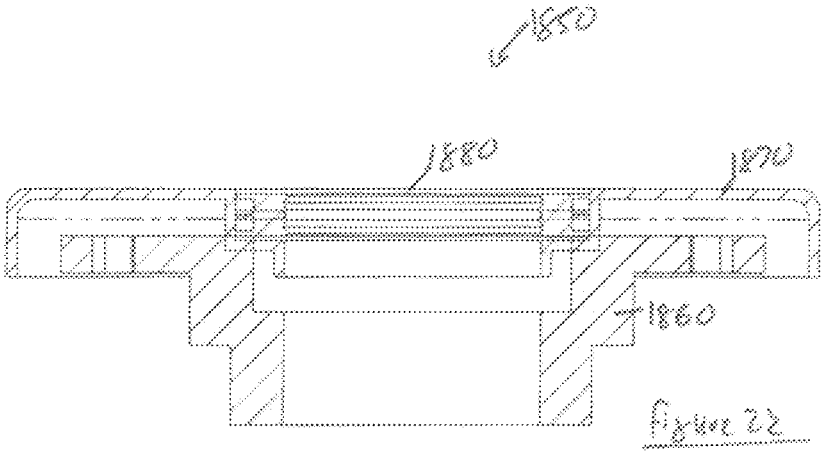
FIG. 22 is a cross section view of a wiper ring of the adjustable height toilet of FIG. 1.
Figure 23:
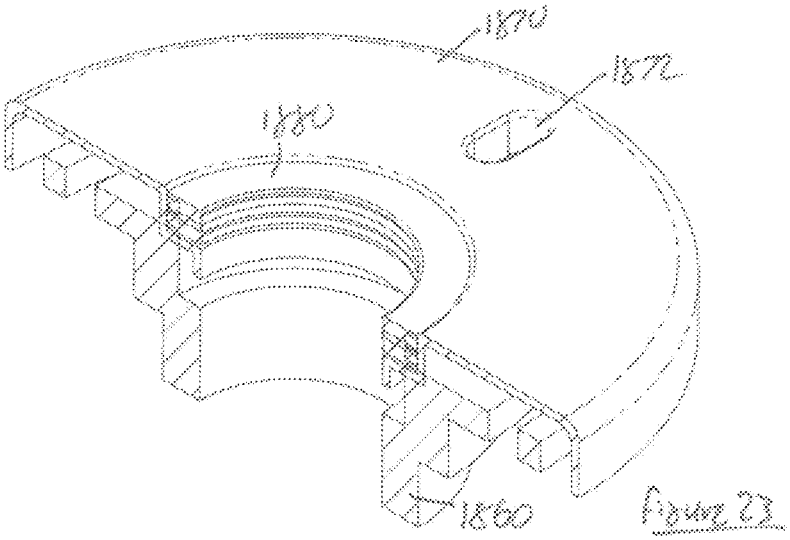
FIG. 23 is a perspective view of the cross section of FIG. 22.
Figure 24:
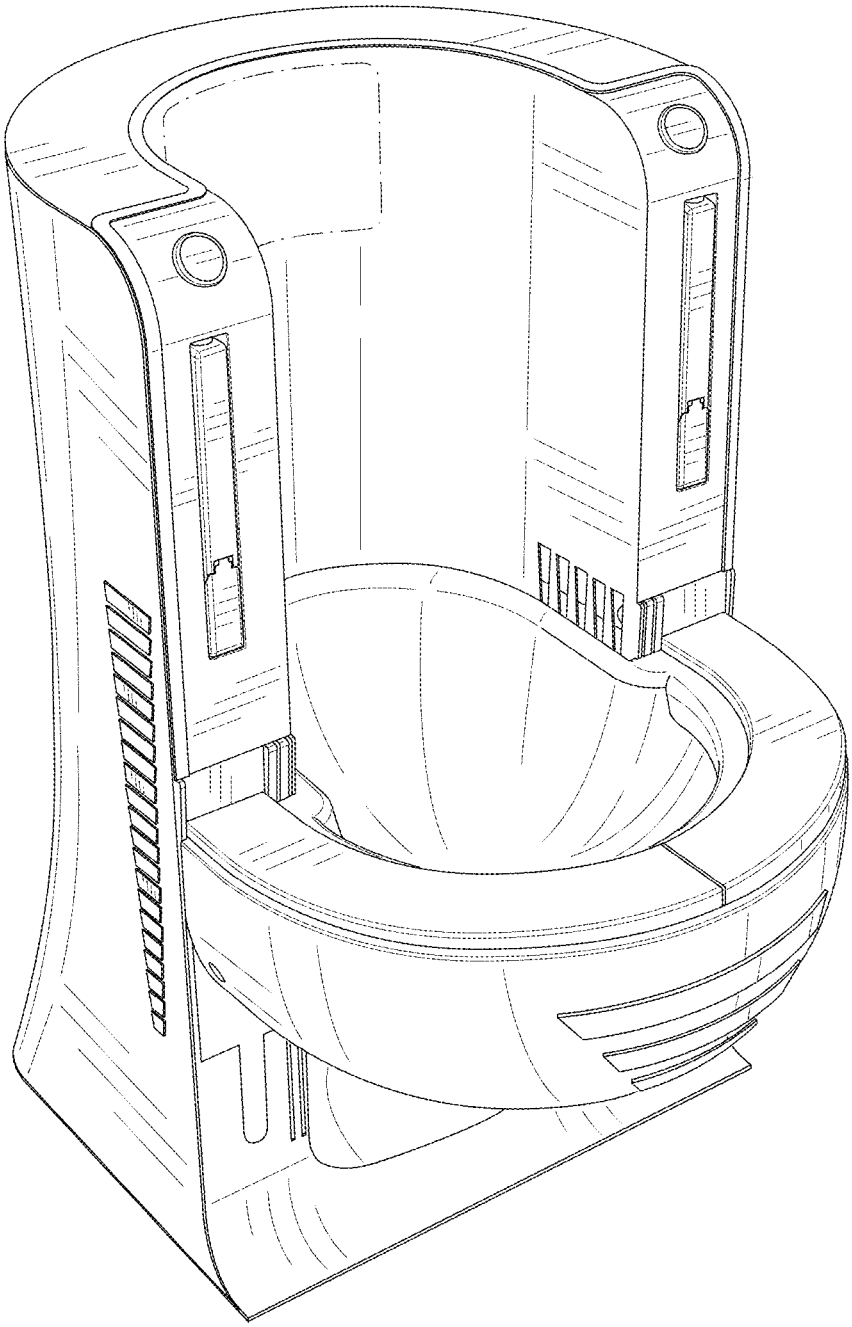
FIG. 24 is a perspective view of an adjustable height toilet according to another embodiment.
Figure 26:
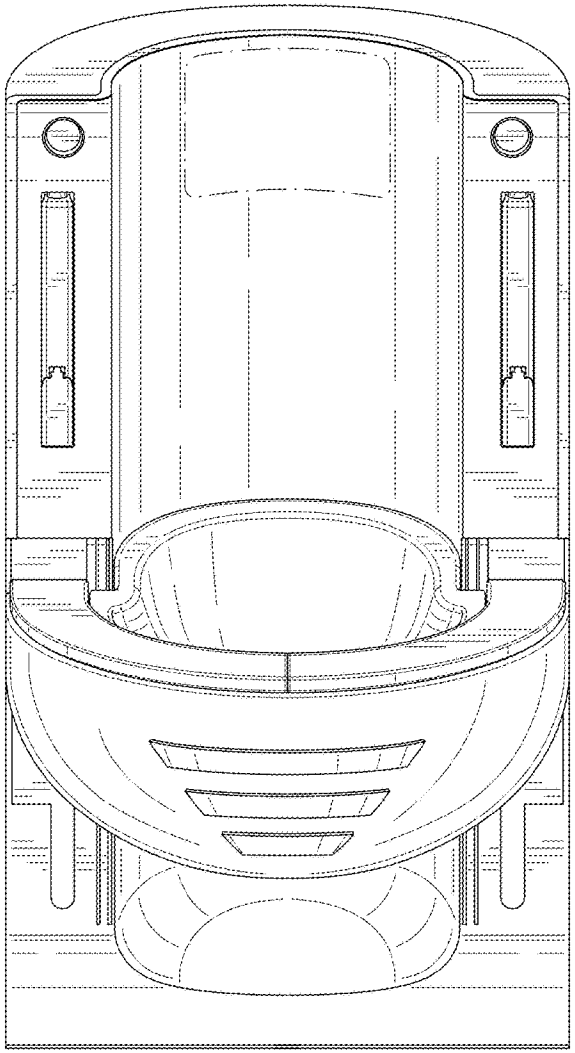
FIG. 26 is a front perspective view of the adjustable height toilet of FIG. 24.
Figure 25:
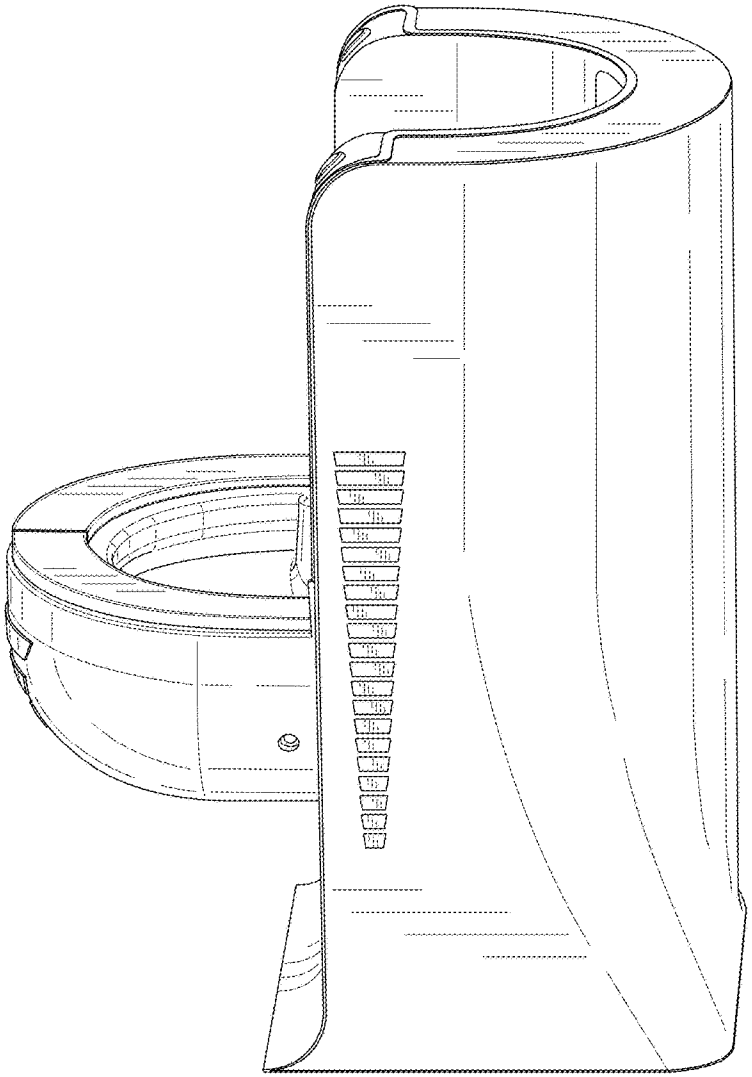
FIG. 25 is a side perspective view of the adjustable height toilet of FIG. 24.
Figure 28:
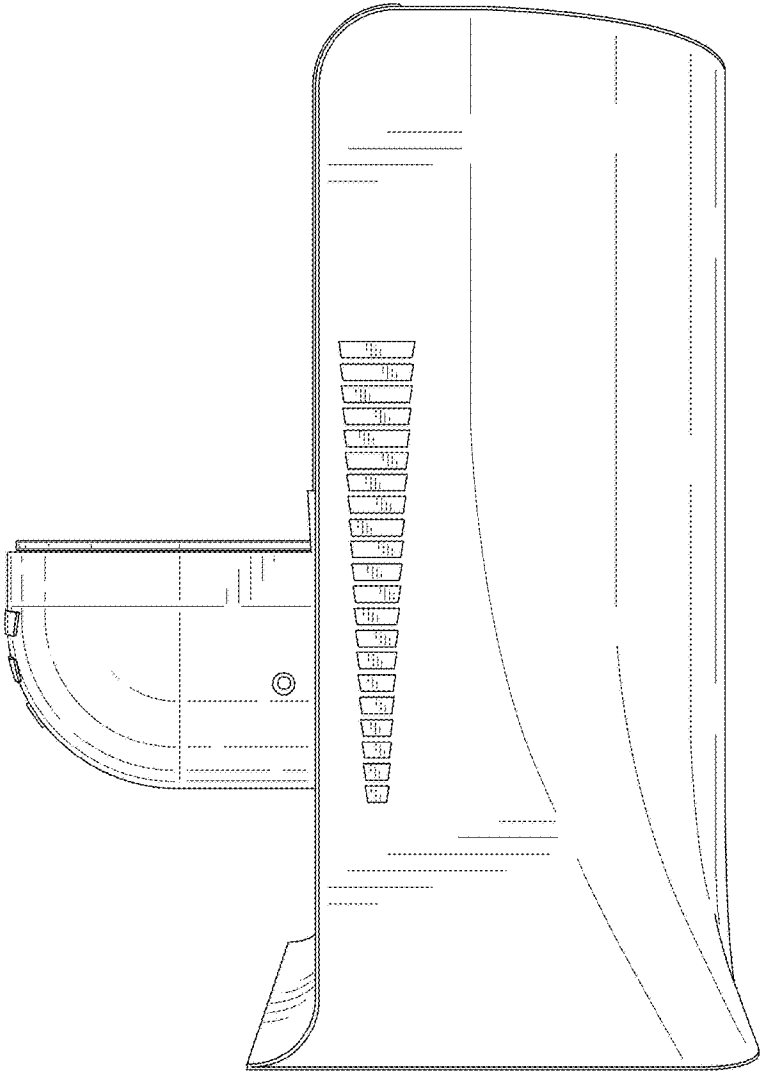
FIG. 28 is a side view of the adjustable height toilet of FIG. 24.
Figure 27:
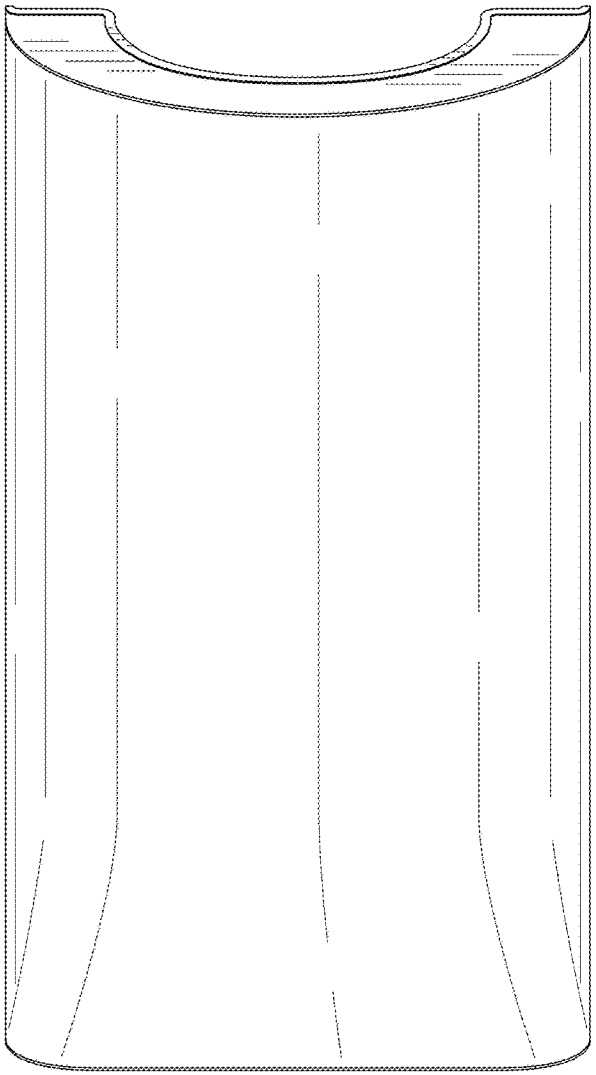
FIG. 27 is a rear perspective view of the adjustable height toilet of FIG. 24.

Turning to FIGS. 22 and 23, toilet 1000 optionally includes an integrated wiper ring assembly, shown generally as 1850, to facilitate installation of the toilet 1000. Wiper ring assembly includes a lower portion 1860, which may be characterized as a closet flange, for coupling to a waste pipe (e.g. part of a drain-waste-vent system), an upper drain ring portion 1870, and a seal member 1880 secured between the upper and lower portions 1870, 1860. Upper and lower portions 1870, 1860 may be made from a fiber-reinforced plastic (e.g. a carbon fiber reinforced thermoplastic) and the like, from a non-reinforced plastic, or from any other suitable rigid material.

Seal member 1880 may be characterized as a seal ring, a wiper ring, or a pipe-wearing ring, and may be made from an elastomer such as rubber, silicone and the like. In use, seal member 1880 provides an airtight seal between outlet end 1234 of waste conduit 1230 and closet flange 1860 when inserted therein, allowing an airtight seal to be formed using a simple insertion fit.

As shown in FIG. 1, upper drain ring portion 1870 is preferably integrally formed with frame 1100, although it may be provided separately in alternative embodiments.

In the illustrated embodiment, one or more apertures 1872 may be provided in upper drain ring portion 1870 and/or closet flange 1860. Apertures 1872 are sized to accept a mechanical fastener (e.g. a hold-down bolt or the like) which may be used to secure frame 1100 to closet flange 1860 after the closet flange has been coupled to a waste pipe.

Slideable Electrical Coupling

The following is a description of an electrical coupling feature that may be used by itself in any toilet or in any combination or sub-combination with any other feature or features disclosed herein including automatically deployable handles, a tilting bowl assembly, a retractable bidet, and/or a motorized toilet seat.

Figure 4:
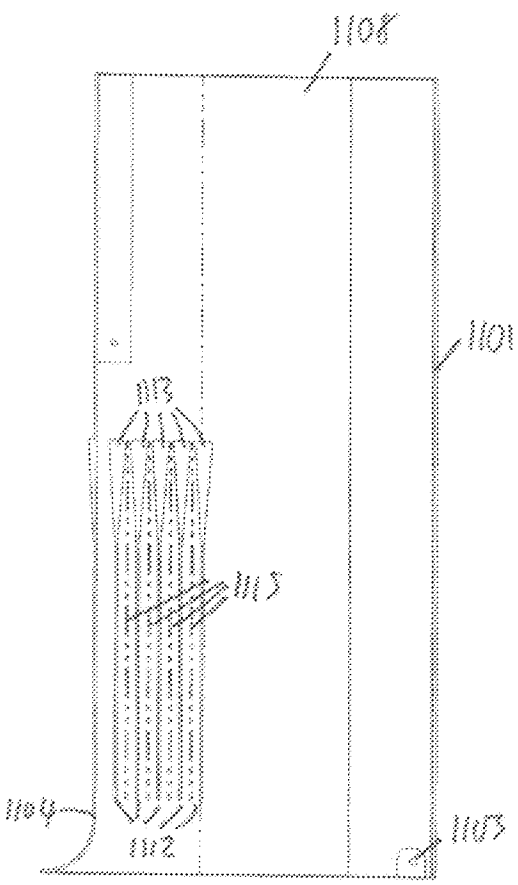
FIG. 4 is a side view of the frame of FIG. 2.
Figure 3:
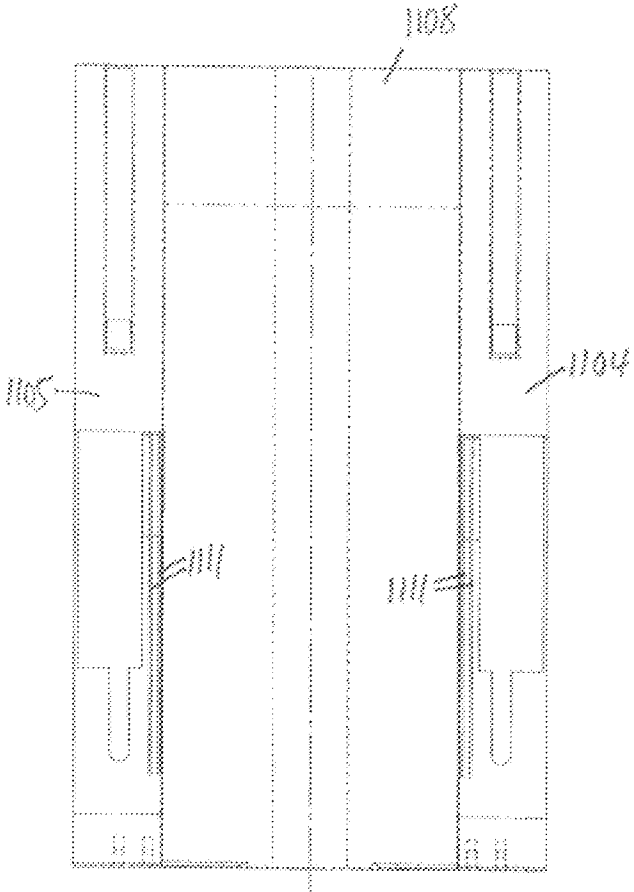
FIG. 3 is a front view of the frame of FIG. 2.

In accordance with this feature, as shown in FIGS. 4-6, one or more strips 1115 of electrically conductive material (e.g. copper) may be provided on, or embedded in, wall member 1108 between slots 1112. Also, as shown in FIGS. 7A and 7B, one or more electrodes 1309 may be provided on side rail assembly 1300 and positioned to abut, or be in close proximity to, strips 1115 as side rail assembly 1300 moves within slots 1112.

As each electrode 1309 remains in contact (or in close proximity to) an aligned strip 1115 as side rail assembly 1300 moves within slots 1112—i.e. as bowl assembly 1200 is raised and lowered—electrodes 1309 and strips 1115 may form part of one or more circuits used to supply power to one or more electrical devices positioned on bowl assembly 1200. Alternatively, or additionally, electrodes 1309 and strips 1115 may form part of one or more circuits used to exchange electrical signals (e.g. digital signals) with one or more electronic control devices (not shown) positioned on frame 1100.

It will be appreciated that some of the embodiments disclosed herein may not use any of the features of the slideable electrical coupling feature disclosed herein and that, in those embodiments, bowl assembly 1200 and frame 1100 may be electrically coupled using one or more cables or wires that are long enough to accommodate vertical movement of bowl assembly 1200, or wired electrical coupling may not be provided.

Automatically Deployable Handles

The following is a description of automatically deployable handles that may be used by itself in any toilet or in any combination or sub-combination with any other feature or features disclosed herein including a slideable electric coupling, a tilting bowl assembly, a retractable bidet, and/or a motorized toilet seat.

In accordance with this feature, a pair of handles may be automatically deployed as the bowl assembly 1200 approaches the upper limit of its vertical travel. An advantage of this design is that a separate actuator is not needed to deploy the handles from a retracted or stowed position when the bowl assembly 1200 is raised to the upper limit of its vertical travel. Another advantage is that since the handles are mounted to frame 1100, the handles will not lower or tilt if bowl assembly is lowered or tilted, providing stable support for a user regardless of the position of bowl assembly 1200.

As exemplified in FIGS. 12 to 15C, a deployable handle assembly, referred to generally as 1600, is provided in a handle recess 1160 located in each of front supports 1104, 1105. Handle assembly 1600 includes a movable handle portion 1602 and a stationary handle portion 1604. The handle portions 1602, 1604 are pivotally coupled to each other using a shaft 1616, although in alternative embodiments any other suitable coupling mechanism may be used.

Figure 13:
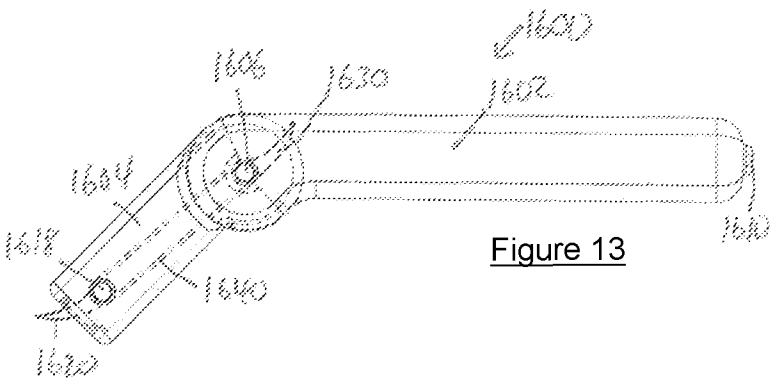
FIG. 13 is a perspective view of a handle for the adjustable height toilet of FIG. 1.
Figure 14A:
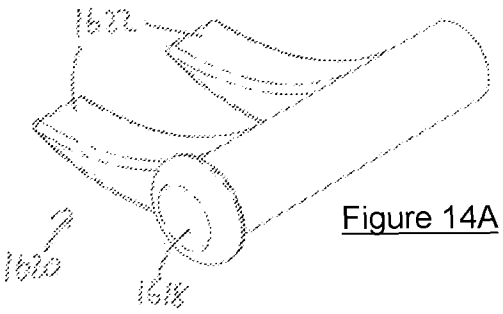
FIG. 14A is a perspective view of a handle engagement member of the handle of FIG. 13.
Figure 14B:
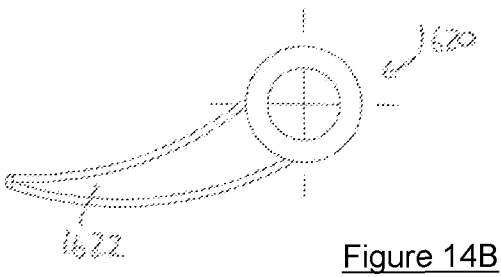
FIG. 14B is a side view of the handle engagement member of FIG. 14A.

As shown in FIG. 13, a handle release member 1620 is provided at a lower end of stationary handle portion 1604. Handle release member 1620 is pivotally coupled to stationary handle portion 1604 by a shaft 1618, although in alternative embodiments any other suitable coupling mechanism may be used. In the illustrated embodiment, handle release member 1620 has a pair of flanges or teeth 1622, although more or fewer flanges or teeth 1622 may be provided in alternative embodiments.

Movable handle portion 1602 and handle release member 1620 are connected by chain or belt 1640 positioned within an interior passage within stationary handle portion 1604. Belt 1640 engages both shaft 1618 and movable handle portion 1602 (e.g. via shaft 1606) such that rotation of handle release member 1620 relative to stationary handle portion 1604 results in a corresponding rotation of movable handle portion 1602 relative to stationary handle portion 1604. For example, looking at FIG. 13, a clockwise rotation of handle release member 1620 about shaft 1618 results in belt 1640 imparting a clockwise rotation of shaft 1606 and/or an internal release member 1630 relative to stationary handle portion 1604, thereby urging rotation of movable handle portion 1602.

Figures 15A, 15B, 15C:
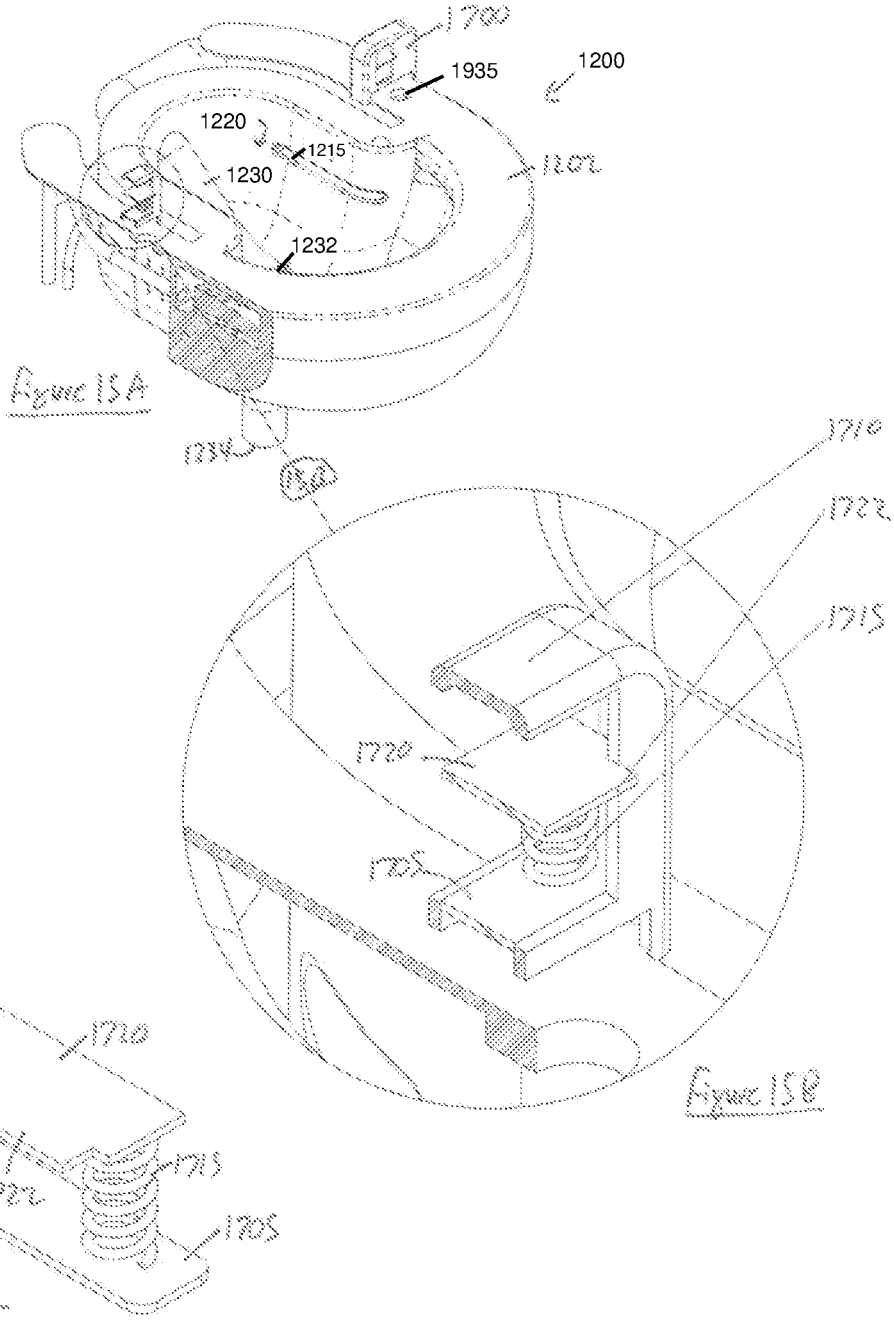
FIG. 15A is a perspective view of a section of the bowl assembly of FIG. 10.
FIG. 15B is an enlarged view of the box 15B in FIG. 15A.
FIG. 15C is a perspective view of a handle engagement member of the bowl assembly of FIG. 10.

Turning to FIGS. 10 and 15A to 15C, bowl assembly 1200 includes a handle deployment assembly, referred to generally as 1700, to contact the handle release member 1620 in order to deploy the handles from a retracted or stowed position. As shown in FIGS. 15A-15C, handle deployment assembly 1700 includes a frame 1710 positioned on an upper portion of bowl assembly 1200, and an engagement edge 1722 projecting forwardly from an engagement member 1720. In the illustrated example, engagement member 1720 is secured to a base 1705 of frame 1710 by a pair of springs 1715, allowing engagement member 1720 to be displaced relative to frame 1710 upon application of a force sufficient to overcome the bias of springs 1715, in order to prevent damage to handle deployment assembly 1700 and/or handle assembly 1600, in the event that movable handle portion 1602 becomes stuck or is otherwise prevented from moving to a deployed position.

Figure 12:
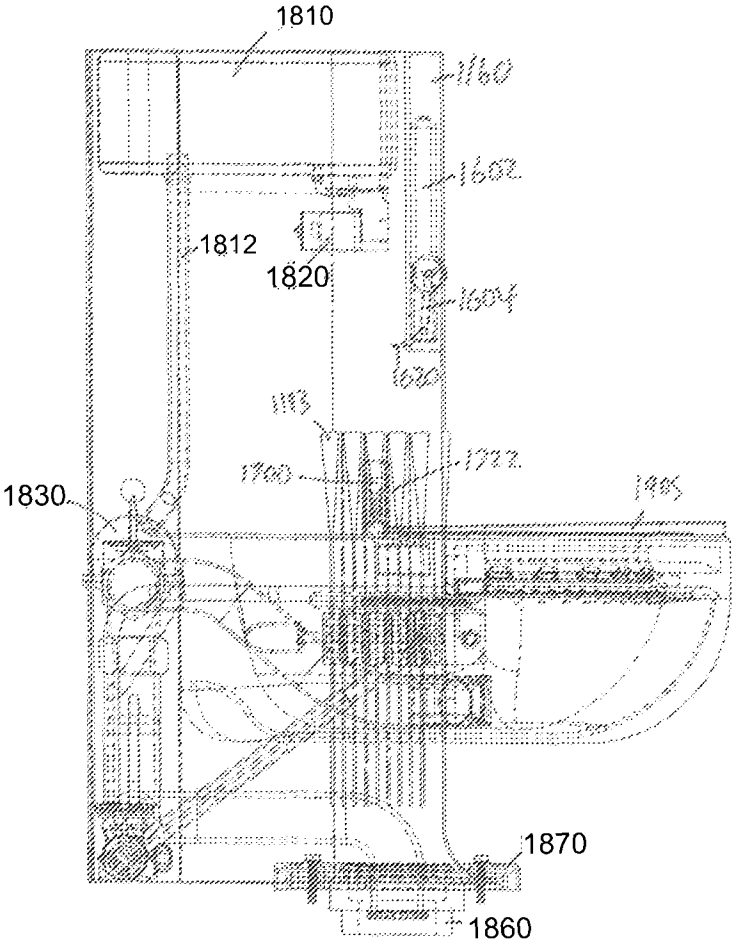
FIG. 12 is a transparent side view of the adjustable height toilet of FIG. 1.

Turning to FIG. 12, handle deployment assembly 1700 is positioned on bowl assembly 1200 such that engagement edge 1722 is vertically aligned with flanges 1622 of handle release member 1620. In this configuration, as the bowl assembly 1200 is raised to the upper limit of its vertical travel, guided by slots 1112, engagement edge 1722 is brought into contact with flanges 1622. As bowl assembly 1200 is raised further, engagement edge 1722 forces handle release member 1620 to rotate relative to stationary handle portion 1604, thereby causing movable handle portion 1602 to move from a stowed position (e.g. as shown in FIG. 12) to a deployed position (not shown).

When bowl assembly 1200 is lowered, engagement edge 1722 is separated from handle release member 1620, leaving the movable handle portion 1602 in a deployed position. Movable handle portion 1602 may be returned to a stowed position manually. Not automatically retracting movable handle portion 1602 may have one or more advantages. For example, if a user is using the handles for support during an inadvertent or unexpected lowering of bowl assembly 1200, the handles will not retract, providing stable support for a user regardless of the position of bowl assembly 1200

Handle assembly 1600 also has one or more manual controls 1610 positioned at the end of movable handle portion 1602. For example, contacting or depressing button 1610 may generate a signal to actuate a bidet feature, or to enable tilting of bowl assembly 1200.

It will be appreciated that some of the embodiments disclosed herein may not use any of the features of the automatically deployable handles disclosed herein and that, in those embodiments, handles may not be provided, or any alternative handles known in the art may be used.

Tilting Bowl Assembly

The following is a description of a tilting bowl feature that may be used by itself in any toilet or in any combination or sub-combination with any other feature or features disclosed herein including automatically deployable handles, a slideable electric coupling, a retractable bidet, and/or a motorized toilet seat.

In accordance with this feature, a lower portion of each slot 1112 is of substantially constant width, such that when flanges 1304 of side rail assembly 1300 are positioned in the lower portions of slots 1112, flanges 1304 (and thus side rail assembly 1300) are prevented from pivoting towards or away from front supports 1104, 1105. However, as shown in FIG. 4, an upper portion 1113 of each slot widens or tapers outwardly, such that when flanges 1304 are positioned in the upper portions 1113, flanges 1304 (and thus side rail assembly 1300 and bowl assembly 1200) may pivot forwardly or rearwardly when bowl assembly 1200 has reached the upper limit of its vertical travel. FIG. 18 illustrates adjustable height toilet 1000 with bowl assembly 1200 tilted forwardly.

Facilitating the pivoting of bowl assembly 1200 when the bowl assembly 1200 is at or near the upper range of slots 1112 may have one or more advantages. For example, allowing bowl assembly 1200 to tilt forwardly may make it easier for a user to dismount from the toilet, as momentum developed during forward rotation of the bowl assembly may provide a 'lift off' effect.

It will be appreciated that some of the embodiments disclosed herein may not use any of the features of the tilting bowl disclosed herein and that, in those embodiments, a tilting bowl may not be provided.

Retractable Bidet

The following is a description of a bidet assembly that may be used by itself in any toilet or in any combination or sub-combination with any other feature or features disclosed herein including automatically deployable handles, a slideable electric coupling, a tilting bowl assembly, and/or a motorized toilet seat.

Figure 17:
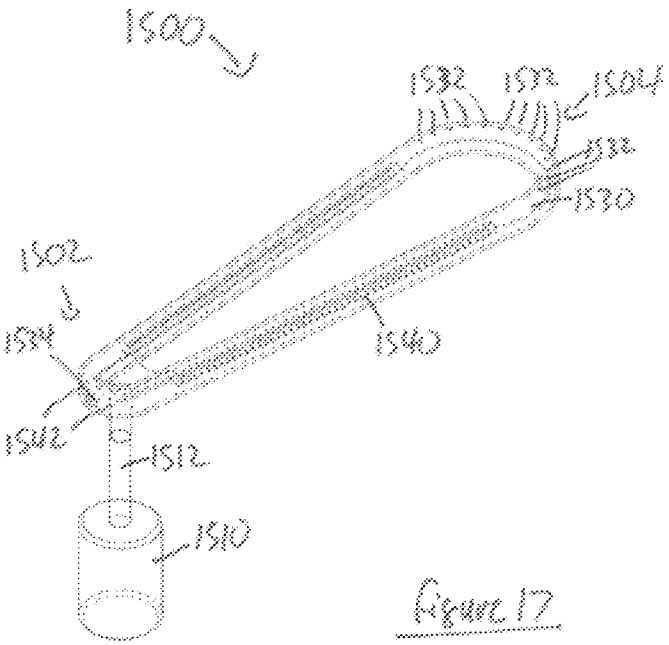
FIG. 17 is a perspective view of a bidet assembly of the adjustable height toilet of FIG. 1.
Figure 16:
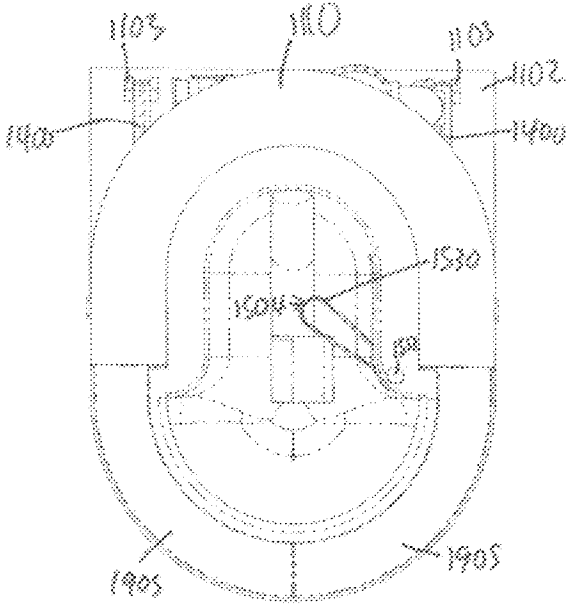
FIG. 16 is a top view of the adjustable height toilet of FIG. 1.

As exemplified in FIGS. 16 and 17, a bidet assembly, referred to generally as 1500, may optionally be provided within bowl assembly 1200. Bidet assembly 1500 includes a conduit 1530 having a water inlet 1534 at a proximal end 1502 and a plurality of water outlets 1532 provided on an upper surface of a distal end 1504 of conduit 1530. In use, water is selectively introduced through inlet 1534 under sufficient pressure to generate upwardly projecting water jets emanating from outlets 1532.

Preferably, one or more heating elements (e.g. resistive heating elements) 1540 are provided within conduit 1530. For example, an electric current may be applied to heating element 1540 via wiring 1542 to raise the temperature of water in conduit 1530.

Bidet assembly 1500 is preferably secured to bowl assembly 1200 with a pivoting coupling, allowing the distal end 1504 and the water outlets 1532 to be selectively moved from a retracted position, in which the conduit 1530 is positioned within recess 1215 (see FIG. 10), and a deployed position, e.g. as shown in FIG. 16, in which the distal end is positioned at or near the center of bowl assembly 1200. Conduit 1530 may be selectively moved between the retracted position and the deployed position using a motor 1510 to pivot a shaft 1512 secured to the proximal end 1502, or alternatively using any other suitable means.

It will be appreciated that some of the embodiments disclosed herein may not use any of the features of the bidet assembly disclosed herein and that, in those embodiments, a bidet assembly may not be provided, or any alternative bidet assembly known in the art may be used.

Motorized Toilet Seat

The following is a description of a motorized toilet seat that may be used by itself in any toilet or in any combination or sub-combination with any other feature or features disclosed herein including automatically deployable handles, a slideable electric coupling, a tilting bowl assembly, and/or a retractable bidet.

As exemplified in FIGS. 20A to 21, a toilet seat, referred to generally as 1900, may optionally include a pair of toilet seat portions 1905. Each seat portion 1905 has a front end 1902, a rear end 1904, an upper surface 1906, and a lower surface 1908.

As shown in FIGS. 20A and 20B, a slot or track 1910 is provided on lower surface 1908, extending from rear end 1904. Preferably, one side of track 1910 is provided with a plurality of teeth or other engagement features 1912, while the opposite side is relatively smooth. In such an arrangement, when a seat portion 1905 is positioned so that a toilet seat driving member such as a sprocket (not shown) is positioned in track 1910, rotation of the sprocket results in translation of the toilet seat portion 1905 relative to the sprocket.

As shown in FIG. 5, a seat drive motor 1930 may be provided on each side of bowl assembly 1200, to selectively drive a sprocket (not shown), e.g. projecting upwardly from an aperture 1935 (see FIG. 10). In such an arrangement, one or both seat portions 1905 may be selectively translated between a deployed position in which front ends 1902 abut or are in close proximity (e.g. as shown in FIG. 1), and a retracted position in which most or all of seat portions 1905 are positioned rearward of front supports 1104, 1105 (not shown) using seat drive motors 1930.

In some embodiments, toilet 1000 may be configured such that in response to an initiation of a flush cycle, seat drive motors 1930 are actuated to translate seat portions 1905 to a retracted position prior to actuating vacuum control valve 1830, to discourage a user from flushing toilet 1000 while seated on bowl assembly 1200.

Optionally, one or more seat cleaning devices may be provided. For example, a brush, sponge, microfiber, or other material may be positioned rearward of front supports 1104, 1105 and in contact with the upper surface 1906, such that when seat portions 1905 are translated to a retracted position, dirt or debris is removed from upper surface 1906. Preferably, a reservoir of cleaning fluid is also provided, for dispensing cleaning fluid onto the brush, sponge, microfiber, or other material, and/or onto upper surface 1906 to provide enhanced cleaning. Alternatively, or additionally, one or more UV light emitters may be provided to assist in disinfection of upper surface 1906 and/or the seat cleaning device(s).

It will be appreciated that some of the embodiments disclosed herein may not use any of the features of the motorized toilet seat disclosed herein and that, in those embodiments, the toilet seat may be of various constructions and that in those embodiments any toilet seat known in the art may be used.

General Description of an Adjustable Height Toilet According to Another Embodiment Reference is now made to FIGS. 29 to 61 showing an adjustable height toilet 2000 according to another embodiment. Elements having similar structure and/or performing similar function as those in the example adjustable height toilet in FIGS. 1 to 28 are numbered similarly, with the reference numerals incremented by 1000.

Figure 29:
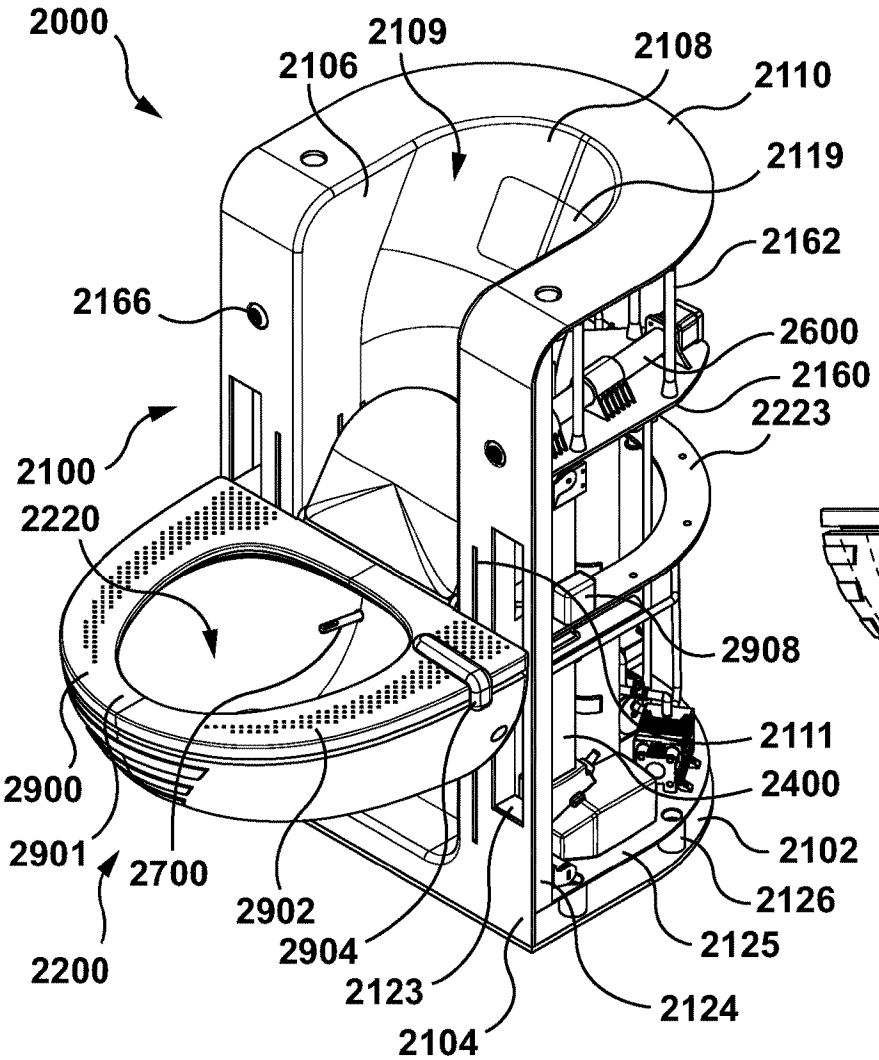
FIG. 29 is a perspective view of an adjustable height toilet according to another embodiment, with an outer covering not shown for ease of understanding.

Referring to FIG. 29, the adjustable height toilet 2000 includes a frame 2100 and a bowl assembly 2200 that is movably connected to the frame 2100 such that, similar to the adjustable height toilet 1000, the height of the bowl assembly 2200 relative to the frame 2100 can be selectively adjusted, thereby adjusting the height of a toilet seat 2900 relative to a surface on which the frame 2100 is positioned.

Figure 34:
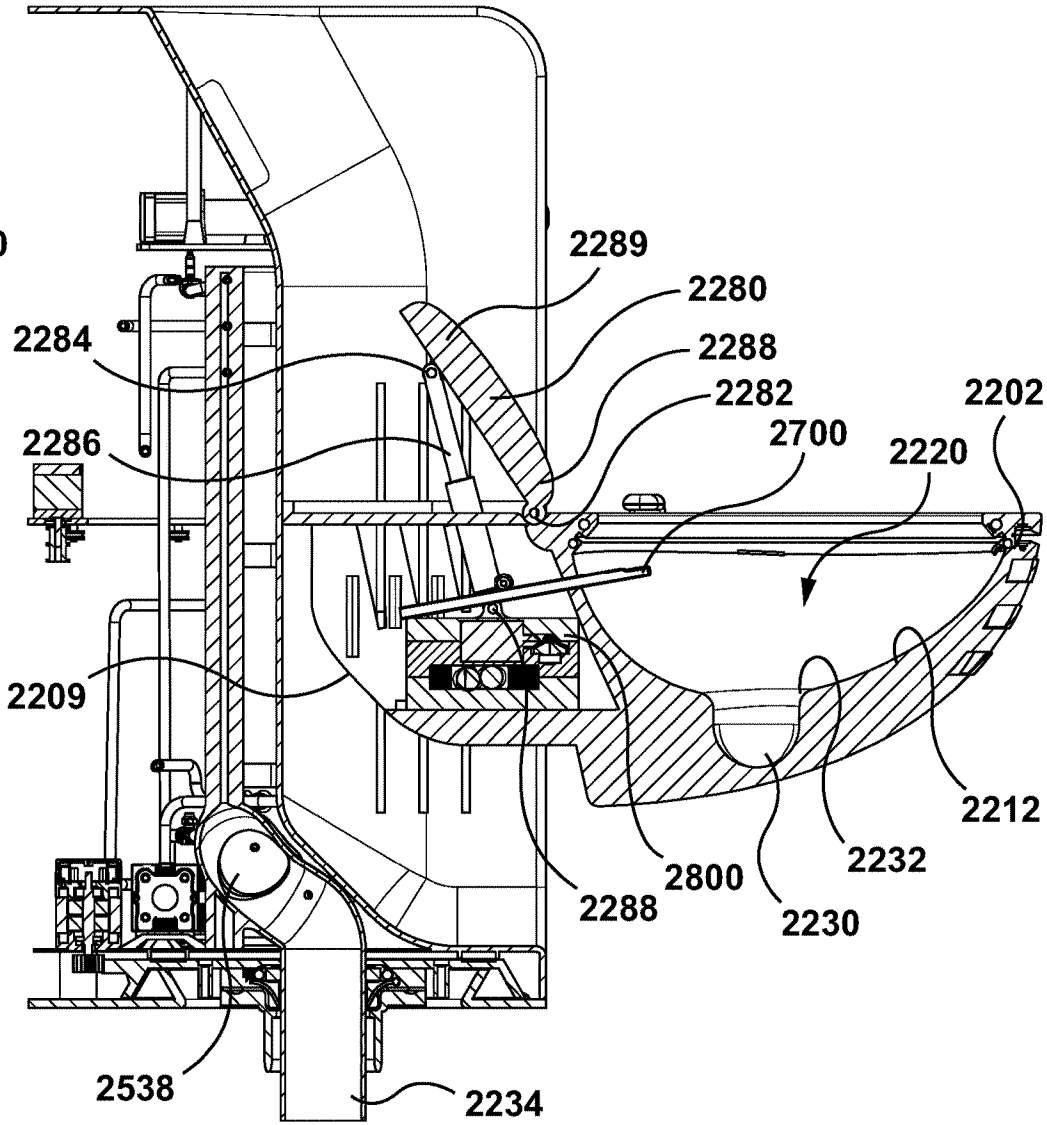
FIG. 34 is a section view of the adjustable height toilet of FIG. 29 taken along the line 34-34 in FIG. 33.
Figure 36:
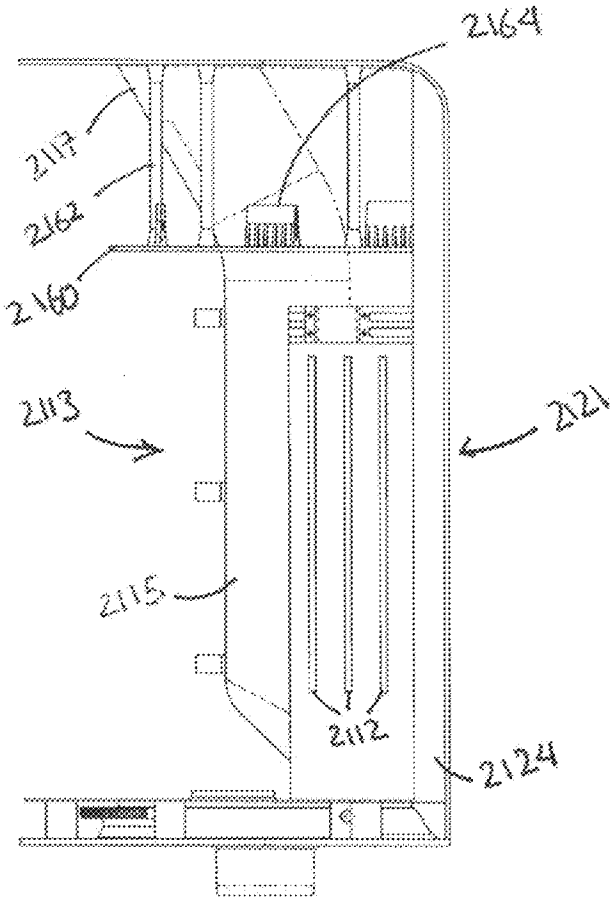
FIG. 36 is a side view of the frame of FIG. 35.
Figure 35:
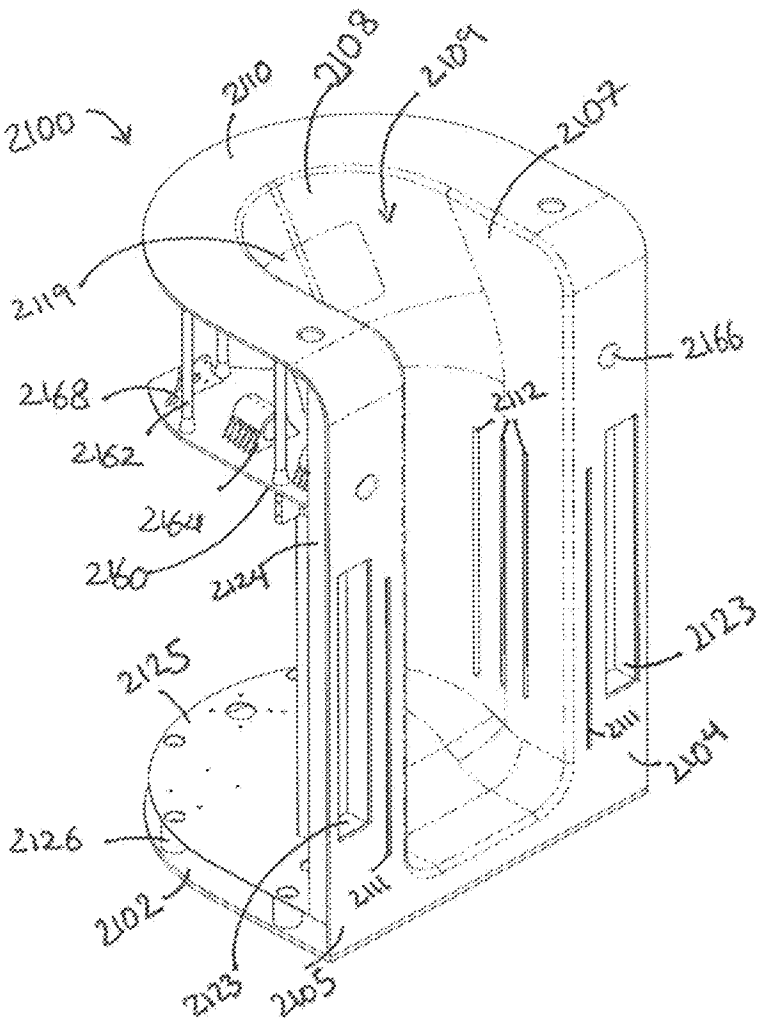
FIG. 35 is a perspective view of a frame of the adjustable height toilet of FIG. 29.
Figure 41:
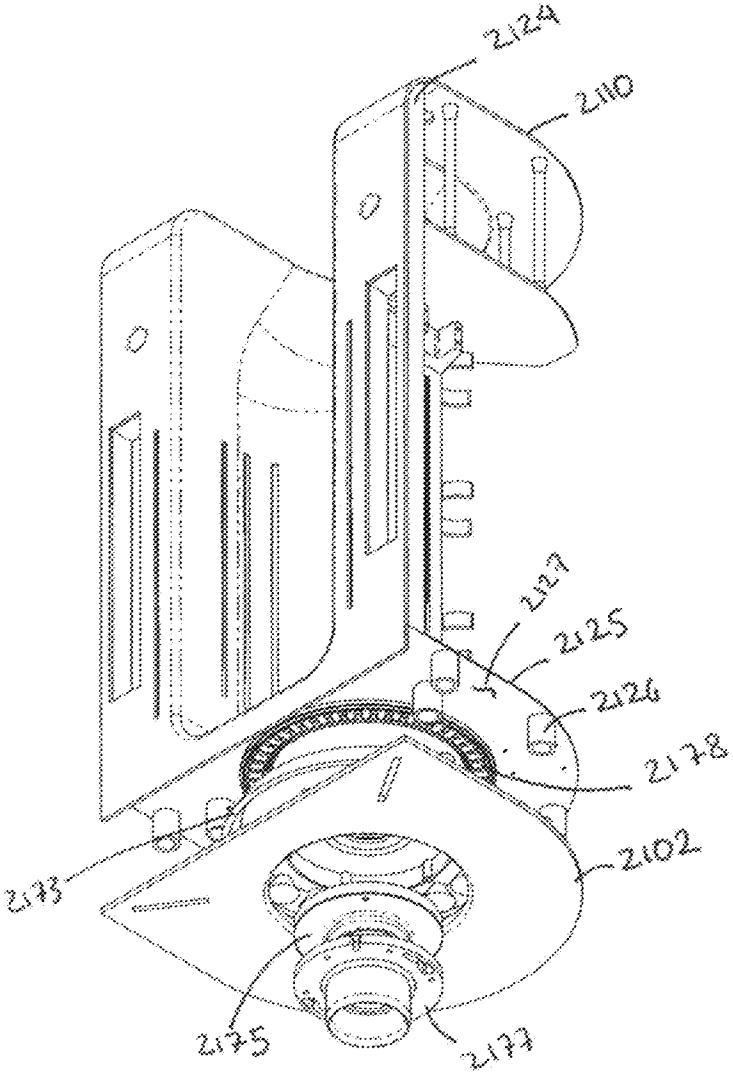
FIG. 41 is a bottom perspective view of the frame of FIG. 35 showing the rotatable floor mount assembly in the exploded configuration.
Figure 40:
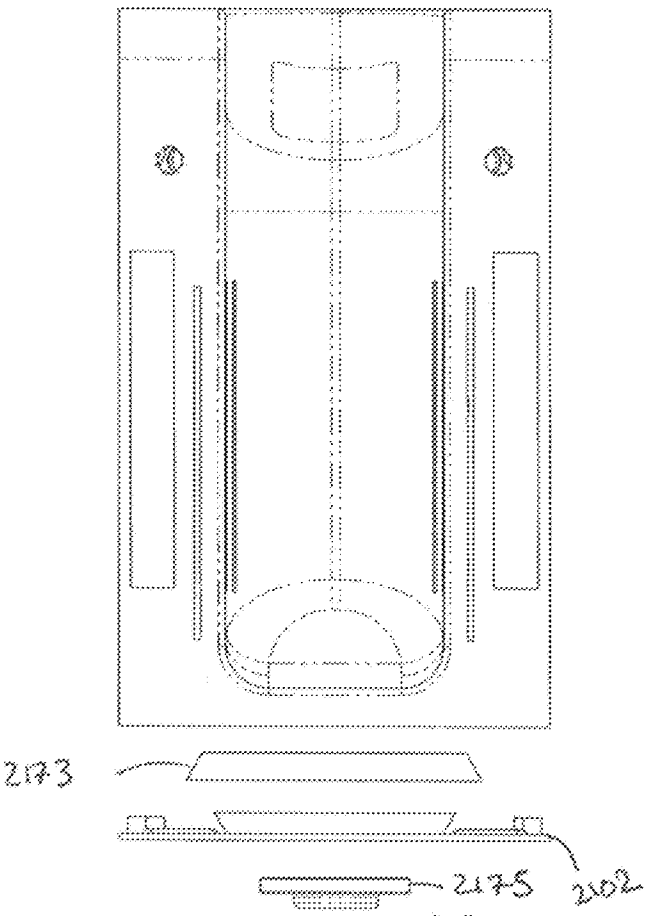
FIG. 40 is a front view of the frame of FIG. 35 showing a rotatable floor mount assembly of the frame in an exploded configuration.
Figure 44:
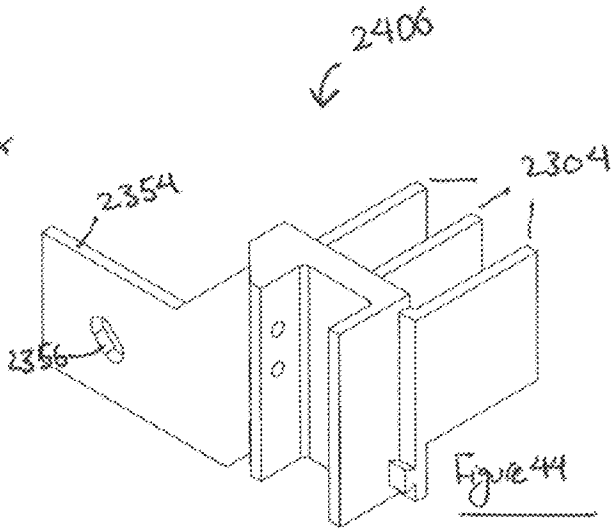
FIG. 44 is a perspective view of a bowl engagement assembly comprising the transverse bowl engagement member of FIG. 43 and the forward facing bowl engagement member of FIG. 42.

Referring to FIGS. 29, 35, and 36, in the illustrated example, frame 2100 includes a base 2102 and a wall member 2108 extending generally upwardly from the base 2102. The wall member 2108 has a rear portion 2113 that is generally curved and defines a recess 2109 in which a rear portion 2209 of the bowl assembly 2200 (see e.g FIGS. 34 and 56) is received. In the illustrated example, the recess 2109 may be characterized as generally U-shaped, although in other examples the recess may be of any other suitable shape.

As can be seen from FIG. 36, in the illustrated example, the generally U-shaped curved rear portion 2113 has a bottom part 2115 and a top part 2117 integrally connected to the bottom part 2115, although in other embodiments the bottom part 2115 and the top 2117 part may not be integrally formed. The bottom part 2115 of the curved rear portion 2113 is generally curved about a vertical axis, and receives the rear portion 2209 of the bowl assembly 2200. In the illustrated example, the top part 2117 of the curved rear portion 2113 is angled rearwardly, although in alternative embodiments the top part 2117 may be generally vertical.

In the illustrated example, an optional display 2119 is located in the top part 2117. The display 2119 may display information such as time, inside temperature, outside temperature, weather condition, information about the adjustable height toilet 2000 and how to operate it, etc. The display 2119 may be an LCD display, an OLED display, or the like.

Referring still to FIGS. 29, 35, and 36, in the illustrated example, the wall member 2108 also has a front portion 2121 that defines a pair of inwardly facing surfaces 2106, 2107. A number of vertically oriented slots 2112 are provided in each surface 2106, 2107. As will be discussed further below, slots 2112 assist in guiding the bowl assembly 2200 as it travels vertically within the frame 2100.

Frame 2100 also includes an upper surface 2110 extending outwardly from the top of wall member 2108. In the illustrated example, the wall member 2108 and the upper surface 2110 are integrally formed, although they may be formed separately in alternative embodiments.

Frame 2100 also includes a pair of upwardly extending front supports 2104, 2105. In the illustrated example, the wall member 2108 and the upwardly extending front supports 2104, 2105 are integrally formed, although they may be formed separately in other examples. A vertically oriented slot 2111 is provided in each support 2104, 2105, respectively. As will be discussed further below, slots 2111 assist in guiding the bowl assembly 2200 as it travels vertically within frame 2100. Also, in the illustrated example, a vertically oriented opening 2123 is provided in each support 2104, 2105 for receiving a seat cleaner rear track portion 2223 of the bowl assembly 2200, as discussed in more detail below.

Frame 2100 also includes a pair of side plates 2124 and a bottom plate 2125. Side plates 2124 are connected to and extend rearwardly from front supports 2104, 2105. The bottom plate 2125 is located above the base 2102 of the frame 2100 and is connected to the side plates 2124. In the illustrated example, the bottom plate 2125 and side plates 2124 are attached to the frame 2100 through side plates 2124 being attached to the front supports 2104, 2105 and an underside of upper surface 2110, although the side plates 2124 may be formed integrally with the front supports 2104, 2105 and upper surface 2110 in other examples. In the illustrated example, the base 2102 of the frame 2100 is formed separately the front supports 2104, 2105. The base 2102 is secured to the bottom plate 2125, e.g. via fasteners (not shown) passing through hollowed posts 2126 located underneath the bottom plate 2125. In other examples, the base 2102 may be integrally formed with the front supports 2104, 2105.

Similar to frame 1100, frame 2100 may be made from any suitable material as known in the art or disclosed herein. Preferably, frame 2100 is made from a material that has relatively high strength and/or stiffness for a relatively thin walled construction, such as a fiber-reinforced plastic (e.g. a carbon fiber reinforced thermoplastic) and the like. In some embodiments, all or a portion of frame 2100 is made of metal, such as aluminum, stainless steel, and the like. Preferably, an optional outer covering is provided to enclose frame 1100, e.g. as shown in FIGS. 24 to 28.

Referring to FIGS. 29 to 32, an actuator, shown generally as 2400, is provided to raise and/or lower bowl assembly 2200 relative to frame 2100. In the illustrated example, the two linear actuators 2400 are provided, one on each side of frame 2100, and located proximate to each front support 2104, 2105. A base portion 2402 of the linear actuator sits on or is otherwise secured to the bottom plate 2125 of the frame 2100. In the illustrated example, the linear actuator 2400 is a ball screw type linear actuator with the actuating member being an electric motor and the translating member being a ball nut translating relative to a ball screw rotated by the electric motor. Alternatively, the linear actuator 2400 may be a hydraulic linear actuator, pneumatic linear actuator, roller screw type linear actuator, or any other suitable linear actuator.

Referring to FIGS. 29 to 32, 42 to 44, and 56 to 61, the translating member of each linear actuator 2400 is connected to a bowl engagement assembly 2406. In this arrangement, as an actuator 2400 is extended, bowl engagement assembly 2406 (and thus bowl assembly 2200) will be displaced upwards (e.g. vertically), guided by slots 2111, 2112, away from base 2102 of frame 2100, thereby raising bowl assembly 2200. Also, when actuator 2400 is retracted, bowl engagement assembly 2406 will be displaced downwards (e.g. vertically), towards base 2102 of frame 2100, thereby lowering bowl assembly 2200.

Figure 43:
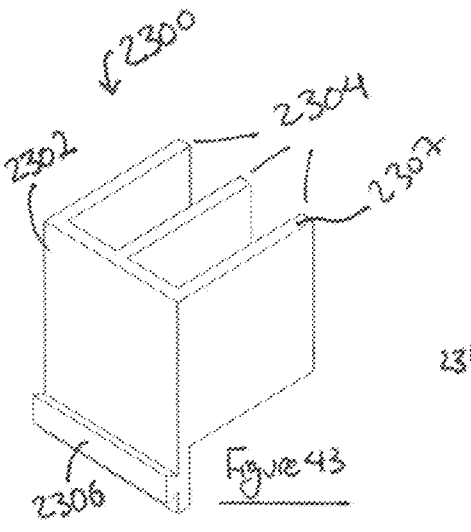
FIG. 43 is a perspective view of a transverse bowl engagement member.

In the illustrated example, bowl engagement assembly 2406 includes a forward facing bowl engagement member 2350 (see FIG. 42) and a transverse bowl engagement member 2300 (see in FIG. 43). The transverse bowl engagement member 2300 includes a base 2302 and a projection 2306 on the base 2302 that is received by a groove 2360 on a base 2352 of the forward facing bowl engagement member 2350, thereby the forward facing and transverse bowl engagement members 2350, 2300 interlock together to form the bowl engagement assembly 2406. In other examples, the forward facing and transverse bowl engagement members 2350, 2300 may be integrally formed or may be connected together through other means known in the art such as use of fasteners, e.g., bolts.

Figures 56, 57, 58, 59:
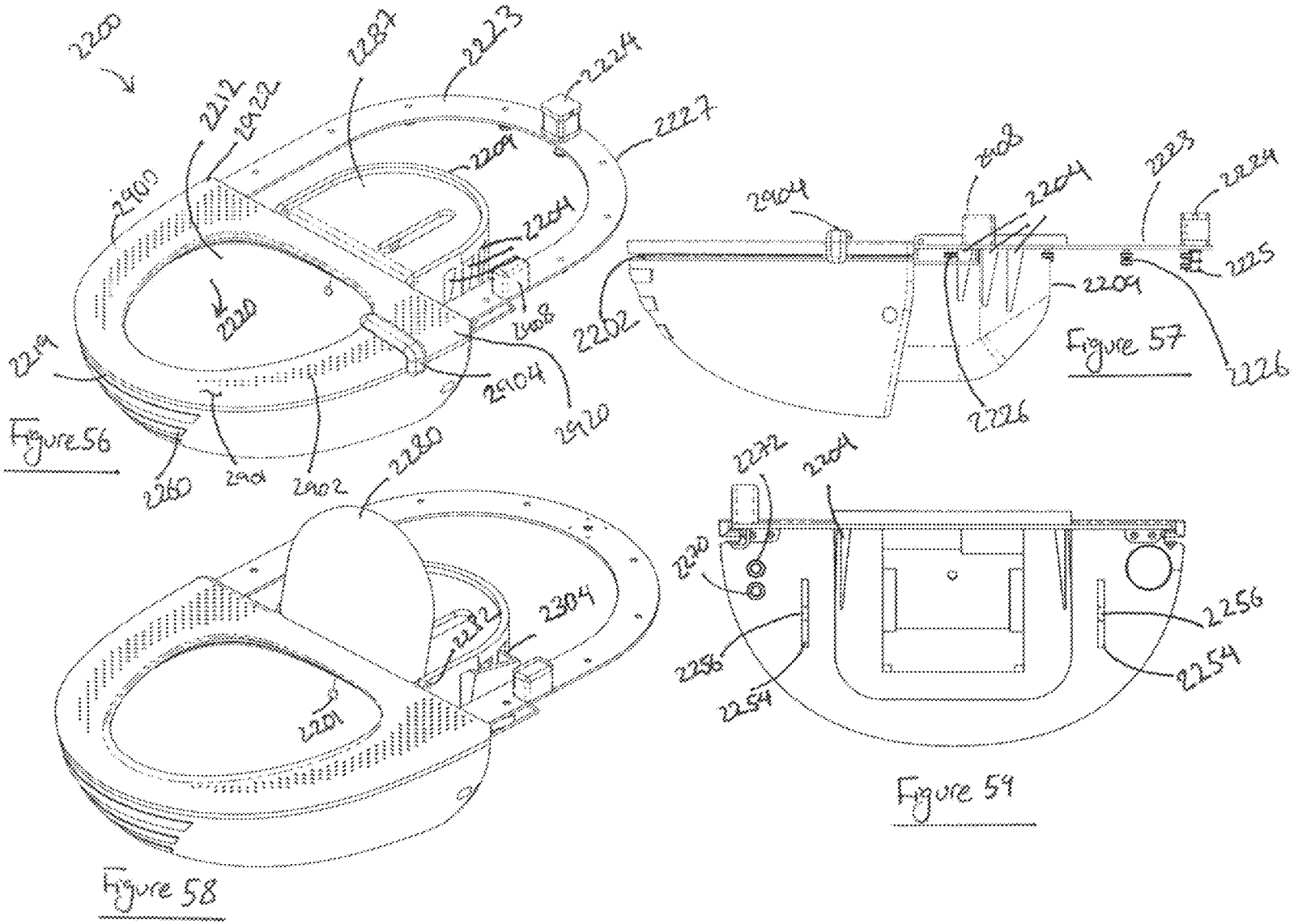
FIG. 56 is a perspective view of the bowl assembly of the adjustable height toilet of FIG. 29.
FIG. 57 is a side view of the bowl assembly of FIG. 56.
FIG. 58 is another perspective view of the bowl assembly showing the transverse bowl engagement member of FIG. 43 engaging the bowl assembly.
FIG. 59 is a rear view of the bowl assembly of FIG. 56.

The transverse bowl engagement member 2300 includes a number of flanges 2304 extending generally perpendicularly from the base 2302. The flanges 2304 are configured to be positioned in the slots 2112 of the frame 2100 to travel in the slots 2112 during the vertical translation of the bowl engagement assembly 2406. Also, slots 2204 are provided on the rear portion 2209 of the bowl assembly 2200 (as best shown in FIG. 57) and configured to receive the flanges 2304 of the transverse bowl engagement member 2300. The flanges 2304 support the bowl assembly 2200 during its (generally vertical) translation relative to the frame 2100.

Figure 30:
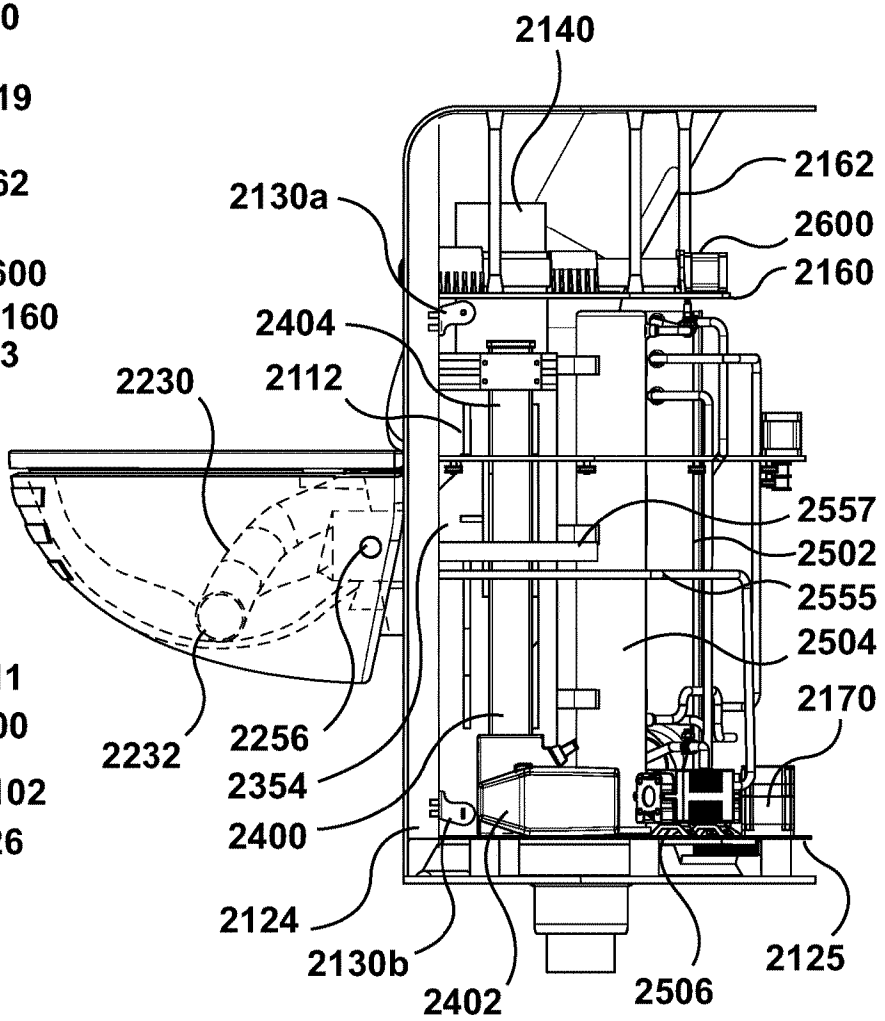
FIG. 30 is a side view of the adjustable height toilet of FIG. 29, with portions of a bowl assembly shown as translucent for ease of understanding.

The forward facing bowl engagement member 2350 includes a flange 2354 extending generally perpendicularly to a sidewall 2358 of the base 2352. The flange 2354 is configured to be positioned in the slot 2111 of the frame 2100 so as to travel within the slot 2111. The forward facing bowl engagement member 2350 has an aperture 2356 on its flange 2354 for use in securing the bowl engagement assembly 2406 to the rear portion 2209 of the bowl 2220. A slot 2254 is provided on the rear of the bowl 2220 (as best shown in FIG. 59) and is configured to receive the flange 2354 of the forward facing bowl engagement member 2350. As best shown in FIGS. 30 and 59, a bore 2256, which is generally transverse to the slot 2254 and intersects the slot 2254, is provided through the bowl 2220. When the forward facing bowl engagement member 2350 is inserted into the slot 2254 of the bowl 2200, a mechanical fastener, such as a bolt, may be positioned in bore 2256 of the bowl 2200 and aperture 2356 of the flange 2354 to secure the forward facing bowl engagement member 2350, and thereby the bowl engagement assembly 2406, to the bowl assembly 2200.

As discussed in more detail below, in some examples, the bowl assembly 2200 may tilt forwardly relative to the frame 2100. In these examples, slots 2204 and slots 2254 of the bowl assembly 2200 may be configured such that the transverse bowl engagement member 2300 and forward facing bowl engagement member 2350 permit tilting of the bowl assembly 2200. For example, as can be seen from FIGS. 43 and 57, the cross section of each flange 2304 of the transverse bowl engagement member 2300 is generally rectangular. However, the slots 2204 are generally triangular (e.g. akin to a truncated triangle with a base that is generally longer than width of the flange 2304), allowing flanges 2304 to be tilted within slots 2204 from a position where the front of the flanges 2304 abut the front edges of the slots 2204 (e.g. in which the bowl assembly is generally horizontal), to a position where the rear of the flanges 2304 abut the rear edges of the slots 2204 (e.g. in which the bowl assembly is tilted generally forwardly). Also, as illustrated in FIG. 59, slots 2254 are generally rectangular, and similar to the cross sectional shape of the flange 2354 of the forward facing bowl engagement member 2350. To accommodate tilting of the bowl assembly 2200, slots 2254 are larger than flanges 2354, and also non-rectangular, so that slots 2254 may be rotated relative to flanges 2354 from a position where the bottom of the flanges 2354 abut the lower edges of the slots 2254 (e.g. in which the bowl assembly is generally horizontal), to a position where the top of the flanges 2304 abut the upper edges of the slots 2254 (e.g. in which the bowl assembly is tilted generally forwardly).

With the bowl assembly 2200 secured to the translating member of the linear actuator 2400 (e.g. via bowl engagement assembly 2406, the height of the bowl assembly 2200 can be adjusted relative to the frame 2100 by the actuator 2400. In FIG. 30, the bowl assembly 2200 is shown in an intermediate position, between the upper and lower limits of its travel. During raising or lowering of the bowl assembly 2200, slots 2112 and 2111 on the frame 2100 guide flanges 2304 and 2354, respectively, of the bowl engagement member 2406.

As the bowl assembly 2200 is raised and lowered, a seat cleaner rear track portion 2223 of the bowl assembly 2200 travels within openings 2123 in front supports 2104, 2105. Optionally, an adjustable barrier may be provided to occlude openings 2123, e.g. to prevent viewing through the openings, and/or to prevent dust or other debris from passing through the openings.

Referring to FIGS. 30 to 32 and 47, in the illustrated example, the frame 2100 includes two blind rollers 2130*a*, 2130*b* on each side of the frame 2100. Blind rollers 2130*a* are positioned rearward of the front supports 2104, 2105 at a position above the openings 2123 while blind rollers 2130*b* are positioned rearward of the front supports 2104, 2105 at a position below the opening 2123. Blind rollers 2130*a*, 2130*b* are configured to support a flexible material, such as a coated or uncoated fabric (not shown) that may occlude the openings 2123 of front supports 2104, 2105. For example, one end of a flexible sheet-like material may be secured to blind roller 2130*a*, and the other end may be connected to the seat cleaner rear track portion 2223. Similarly, one end of a flexible sheet-like material may be secured to blind roller 2130*b*, and the other end may be connected to the seat cleaner rear track portion 2223. In this arrangement, as the bowl assembly 2200 is raised, material may un-roll from blind roller 2130*b* while material is rolled-up by blind roller 2130*a*, and vice versa when bowl assembly 2200 is lowered. Alternatively, ends of a single piece of material may be secured to blind rollers 2130*a* and 2130*b*, with a central portion of the material secured to bowl assembly 2200. In some embodiments, blind rollers 2130*a*, 2130*b* may be motorized and their respective motor may extend or retract the sheet-like material in sync with the relative vertical movement of the bowl assembly 2200.

Figure 32:
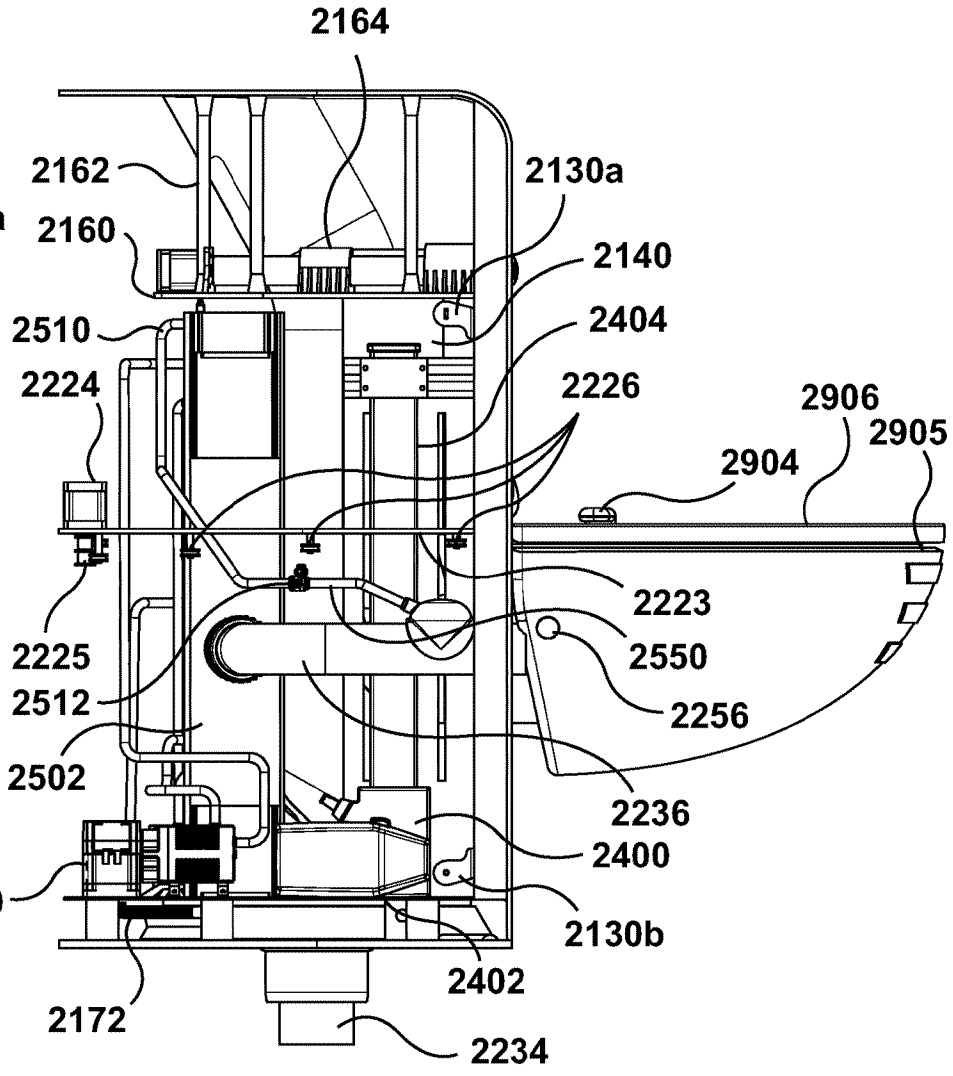
FIG. 32 is another side view of the adjustable height toilet of FIG. 29 showing a side opposite to that shown in FIG. 30.
Figure 31:
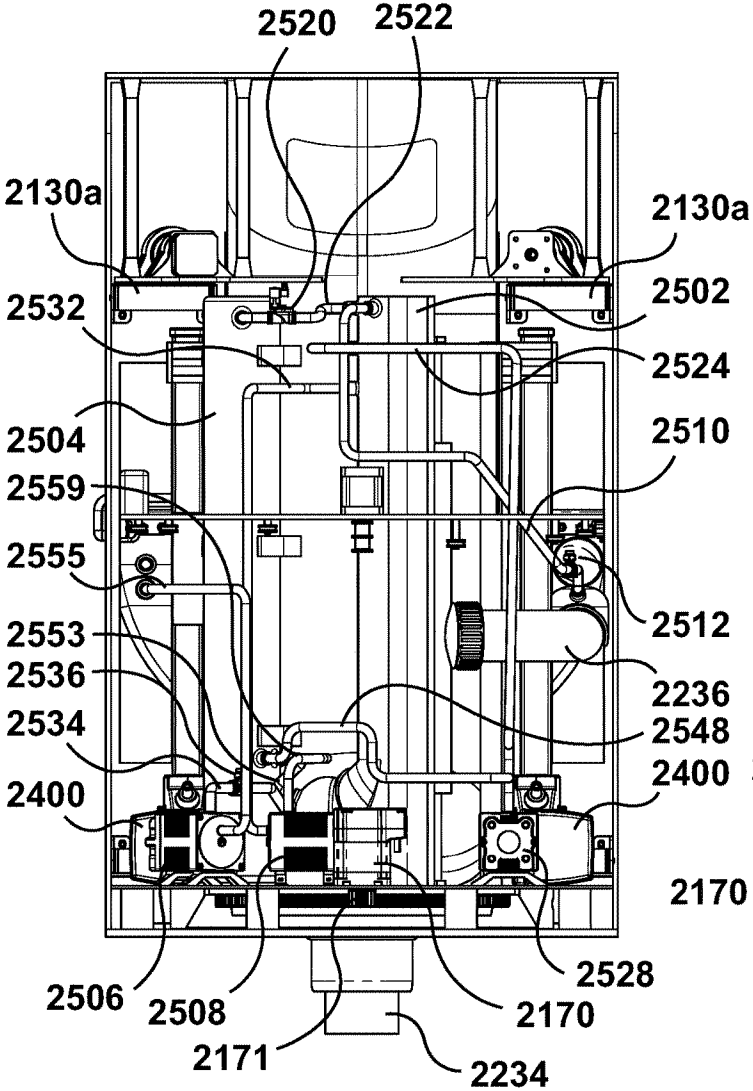
FIG. 31 is a rear view of the adjustable height toilet of FIG. 29.
Figure 42:
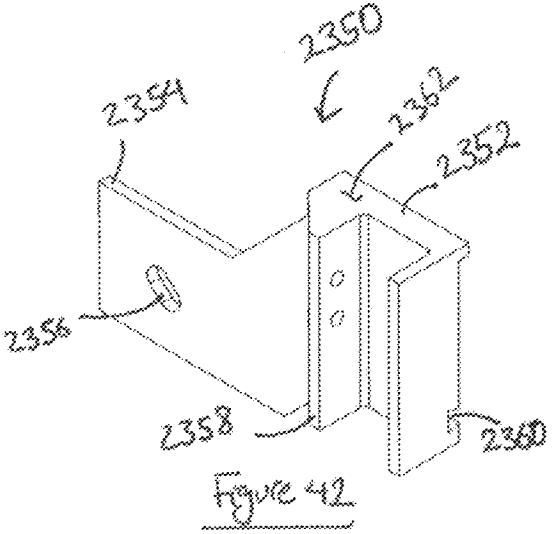
FIG. 42 is a perspective view of a forward facing bowl engagement member.
Figure 45:
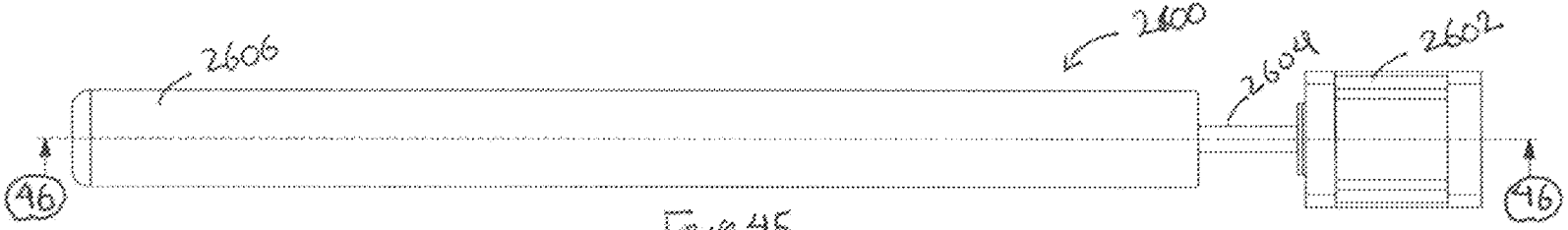
FIG. 45 is a side view of a retractable handle assembly for the adjustable height toilet of FIG. 29.
Figure 46:
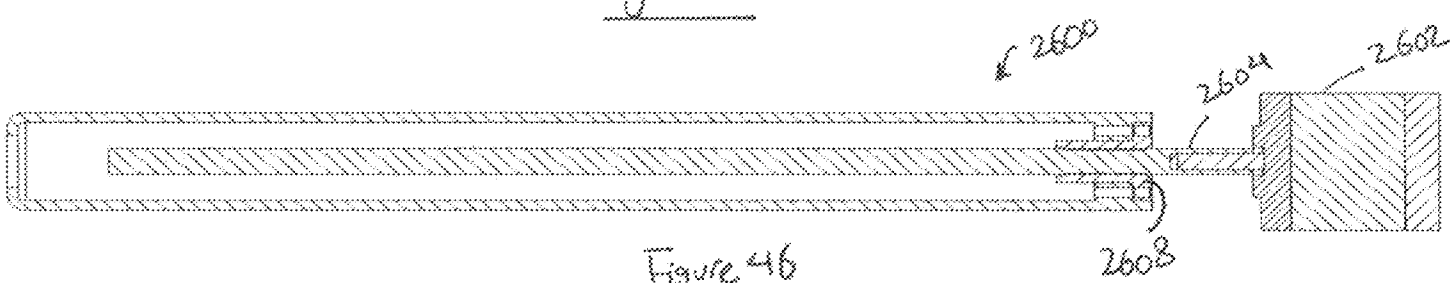
FIG. 46 is a section view of the retractable hand assembly of FIG. 45 taken along the line 46-46 in FIG. 45.

Referring to FIGS. 30, 32 and 42, in the illustrated example, a screen 2140, optionally having a color similar to that of frame 2100, is mounted to top face 2362 of base 2352 of the forward facing bowl engagement member 2350. The screen 2140 is configured to cover slots 2112 when the bowl assembly 2200 is at its lowest vertical position. As the bowl assembly 2200 is lowered, the screen 2140 occlude slots 2112, e.g. to prevent viewing through the slots, and/or to prevent dust or other debris from passing through the slots.

Figure 33:
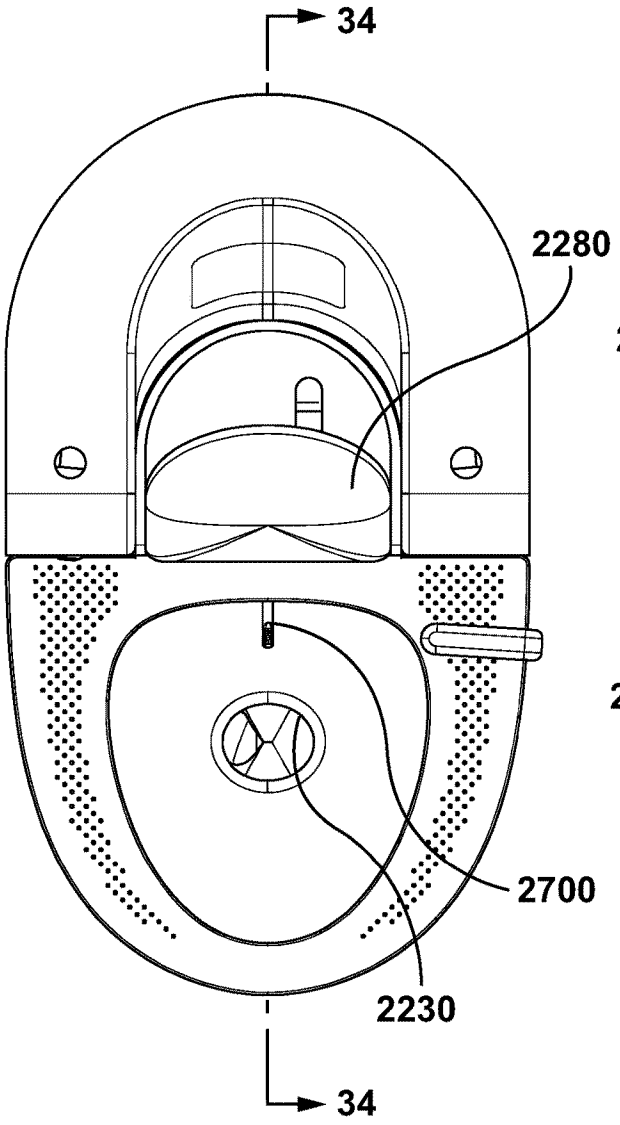
FIG. 33 is a top view of the adjustable height toilet of FIG. 29.

Turning to FIGS. 30 to 34 and 56 to 59, the bowl assembly 2200 includes an interior sidewall 2212 defining the bowl 2220, and an upper surface 2202 on a front portion 2219 of the bowl assembly 2200, on top of which a toilet seat 2900 is located. As can be seen in FIGS. 30, 33 and 34, the bowl assembly 2200 includes a waste conduit 2230 for evacuating contents of the bowl 2220. Waste conduit 2230 has an inlet end 2232 positioned in the lower portion of bowl 2220, and an outlet end 2234 for installation in fluid communication with the plumbing system to which the toilet 2000 is to be installed.

To accommodate vertical movement of the bowl assembly 2200 relative to the frame 2100, and/or tilting of the bowl assembly 2200, an intermediate portion of waste conduit 2230, is configured to elastically deform, deflect, or otherwise accommodate vertical movement and/or tilting of the bowl assembly 2200. For example, the intermediate portion 2236 (in the illustrated example, connecting the portion of the waste conduit located within the bowl 2220 to a low pressure chamber 2502 of a vacuum system used in evacuating contents of the bowl 2220) may be made from a flexible or elastic material (e.g. fiber reinforced rubber, with an optional smooth plastic coating).

Preferably, a vacuum system is provided to assist in evacuating the contents of bowl 2220. Referring to FIGS. 30 to 34 and 49, in the illustrated example, the vacuum system includes a low pressure chamber 2502, a first air pump 2508, a high pressure chamber 2504, and a second air pump 2528.

Air pump 2508 is configured to create a desired vacuum pressure (i.e. a pressure below local atmospheric pressure) in the low pressure chamber 2502, while air pump 2528 is configured to create a pressure higher than the local atmospheric pressure in high pressure chamber 2504. The low pressure chamber 2502 is in fluid communication with air pump 2508 through piping 2532 connected to an inlet 2530 of the low pressure chamber 2502. The high pressure chamber 2504 is in fluid communication with air pump 2528 through piping 2548. The low pressure chamber 2502 is also in fluid communication with air pump 2528 via piping 2524 connected to inlet 2526 of the low pressure chamber 2502. The high pressure chamber 2504 is also in fluid communication with air pump 2508 via piping 2559.

The low pressure chamber 2502 is in fluid communication with high pressure chamber 2504 through solenoid valve 2520 and piping 2522 connected to an inlet 2518 of the low pressure chamber 2502. The low pressure chamber 2502 is in fluid communication with a vacuum control valve 2512 via piping 2510 running between an inlet 2516 of the low pressure chamber 2502 and the vacuum control valve 2512. The vacuum control valve 2512 is in fluid communication with the intermediate portion 2236 of the waste conduit 2230 via piping 2550. An interior of the low pressure chamber 2502 is in fluid communication with the intermediate portion 2236 of the waste conduit 2230 via inlet 2514. An interior of the low pressure chamber 2502 is in fluid communication with outlet end 2234 of the waste conduit 2230 via a pneumatic drain valve 2538 (shown in the illustrated example as a rubberized balloon valve). The pneumatic drain valve 2538 is also in fluid communication with high pressure chamber 2504 via piping 2553 connected to inlet 2552 of the valve 2538. Accordingly, when air pressure within high pressure chamber 2504 falls (e.g. during a flush cycle, as discussed further below), pneumatic drain valve 2538 may deflate and/or become more easily deformable to allow flow past the valve.

Figures 47, 48, 49, 50, 51, 52:
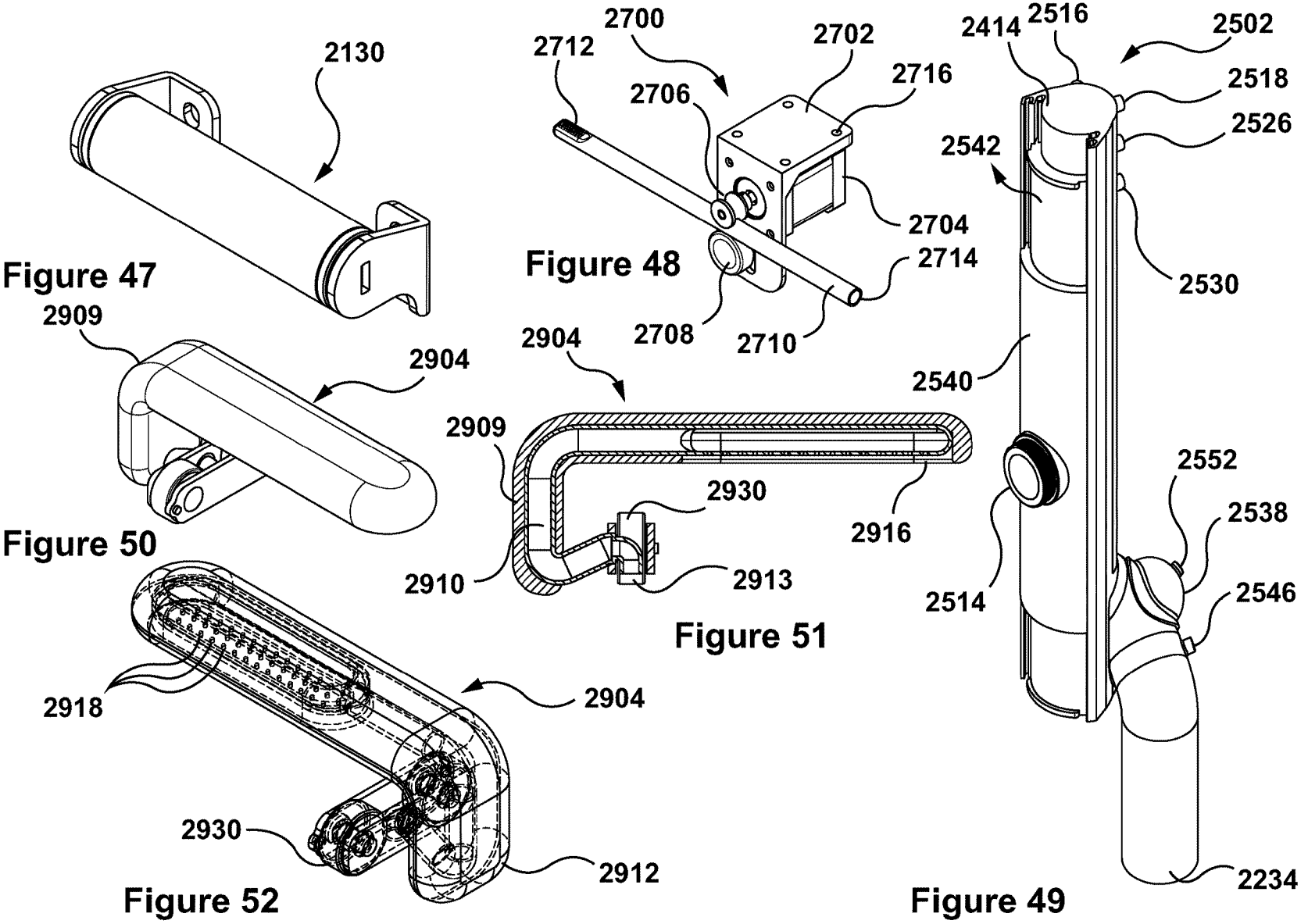
FIG. 47 is a perspective view of a roller assembly for covering certain openings of the frame of FIG. 35.
FIG. 48 is a perspective view of a linear retractable bidet assembly for the adjustable height toilet of FIG. 29.
FIG. 49 is a perspective view of a low pressure chamber of a vacuum system used in evacuating contents of a bowl of the adjustable height toilet of FIG. 29.
FIG. 50 is a perspective view of a seat cleaner for the adjustable height toilet of FIG. 29.
FIG. 51 is a cross section view of the seat cleaner of FIG. 50.
FIG. 52 is a transparent perspective view of the seat cleaner of FIG. 50.

To accommodate vertical movement of the bowl assembly 2200 relative to frame 2100, a portion of the sidewall of low pressure chamber 2502 may slide relative to the rest of the housing. In the illustrated example, the low pressure chamber 2502 includes two slideable sidewalls—a first slideable sidewall 2540 and a second slideable sidewall 2542—and a fixed housing portion 2544 fixed to the frame 2100 (as best seen in FIG. 49). The first slideable sidewall 2540 and the second slideable sidewall 2542 can slide relative to each other and the fixed housing portion 2544. Since inlet 2514 is located on the first slideable sidewall 2540 and the intermediate portion 2236 is also flexible (as discussed above), the intermediate portion 2236 remains in fluid communication with the interior of the low pressure chamber 2502 during movement of the bowl assembly 2200 relative to frame 2100.

Bowl assembly 2200 may also include a water conduit 2557 for introducing water or other liquids to bowl 2220. Water conduit may have an inlet end in communication with a water source (e.g. a municipal water line) and an outlet end connected to the rear of bowl assembly 2200 at as water inlet port 2272, and a plurality of nozzles or outlets positioned about an upper perimeter of bowl 2220. Accordingly, water or other liquids may be selectively introduced into bowl 2220 by providing water to the inlet end under sufficient pressure to flow through water conduit and the outlets.

Operation of the vacuum system is now discussed with reference to FIGS. 30 to 34 and 49. In the illustrated example, when the content of the bowl 2220 needs to be evacuated, the user initiates a flush cycle. Upon doing so, water may be added to the bowl 2220, e.g. via the water conduit 2557, until the fluid level in bowl 2220 is at or above the inlet end 2232 of waste conduit 2230. Thereafter, vacuum control valve 2512 is opened to bring the low pressure chamber 2502 (which has a pressure lower than the local atmospheric pressure as a result of air pump 2508) into fluid communication with intermediate portion 2236 of the waste conduit portion 2230. Thus, when the vacuum control valve 2512 is open, a suction effect may be created. As a result, the contents of the bowl 2220 are directed from the bowl 2220, through the intermediate portion 2236, and to the interior of the low pressure chamber 2502. Next, the vacuum control valve 2512 is closed and solenoid valve 2520 opens to pressurize the low pressure chamber 2502. Air pump 2508 has already pressurized high pressure chamber 2504. By opening the solenoid valve 2520, pressurized air is added to the low pressure chamber 2502 from the high pressure chamber 2504. When the pressure within the low pressure chamber 2502 reaches a predetermined value, the pneumatic drain valve 2538 opens and allows the collected waste to be exit through outlet end 2234 of the waste conduit 2230, and from there evacuated into e.g. a sewer or septic tank.

To prepare the system for the next flush cycle, valves 2520 and 2538 may be closed, air pump 2508 actuated to re-pressurize the high pressure chamber 2504, and air pump 2508 actuated to re-create a lower pressure condition or 'vacuum' within the low pressure chamber 2502. The aforementioned steps can be carried out by a control system (not shown), such as a PLC-based control system.

Referring to FIGS. 30 to 34, 49, and 59, an odor removal system of the toilet 2000 is now discussed. In the illustrated example, the odor removal system includes an odor pump 2506 configured to draw air and odorous particles from the bowl 2220 and expel them into e.g. a waste pipe, as discussed above in relation to toilet 1000. In the illustrated example, the odor pump 2506 is in fluid communication with the bowl 2220 through an opening 2270 located on the rear of the bowl 2220 (as best seen on FIG. 59). The odor pump 2506 is connected through piping 2534 to odor exhaust 2546 of the low pressure chamber 2502. A check valve 2536 is preferably provided to prevent reverse flow from the odor exhaust 2546 through piping 2534 back to odor pump 2506. The bowl 2220 has an air conduit having a plurality of nozzles (not shown) positioned about an upper perimeter of the bowl 2220. This air conduit is in fluid communication with odor conduit 2555 connected to the bowl 2220 through opening 2770 located at the rear of the bowl.

When air and odorous particles needs to be removed from the bowl 2220, the odor pump 2506 may be operated to reduce the air pressure at opening 2270 and thereby at the plurality of nozzles in bowl 2220. As a result, air and odorous particles may be sucked into the piping 2555 from the bowl 2220 through the nozzles. The odor pump 2506 pumps the air and odorous particles into the sewer through odor exhaust 2546.

Similar to toilet 1000, toilet 2000 may include one or more Ultraviolet (UV) light emitters to assist in disinfecting of the interior sidewall 2212.

Tilting Bowl Assembly

The following is a description of another tilting bowl feature that may be used by itself in any toilet, including toilet 1000 and/or toilet 2000, or in any combination or sub-combination with any other feature or features disclosed herein including automatically deployable handles, retractable handles, a slideable electric coupling, a retractable bidet, a linear retractable bidet, a motorized toilet seat, and/or a seat cleaner.

In accordance with this feature, a bowl assembly of a toilet may tilt forwardly relative to a frame of the toilet assembly such that the tilting may make it easier for a user to dismount from the toilet. Another advantage of this design is that a height adjustable bowl assembly may be tilted at any vertical position, in contrast with e.g. the tilting of bowl assembly 1200 relative to frame 1100 at or near the upper range of its vertical travel.

As exemplified in FIGS. 34, 53 to 55, 60 and 61, a bowl tilting assembly includes a drive member 2800 and a follower block 2810. The drive member 2800 and follower block 2810 are placed within a cavity 2290 in the rear portion 2209 of the bowl assembly 2200. The drive member is secured to the bowl assembly 2200. The follower block 2810 can move in the cavity 2290 relative to the bowl assembly 2200, as discussed below.

In the illustrated example, the bowl assembly 2200 includes a number of vertically oriented guide plates 2293 in the cavity 2209. Guide plates 2293 are fixed relative to the bowl assembly 2200. The follower block 2810 can rest against the guide plates 2293. Further, guide plates 2293 are configured to confine the movement of the follower block 2810 relative to the bowl assembly 2200, as discussed in more detail below.

The drive member 2800 includes a motor 2812 with a drive gear 2814 secured to the motor's shaft. The drive gear 2814 is engaged with a transfer gear 2816 which is in turn engaged with gears 2818 of ball screws 2820. Rotation of the motor 2812 results in rotation of ball screws 2820. The drive member 2800 also includes a wedge-shaped cam member 2802. The wedge-shaped cam member 2802 includes two wedge block 2804 on each side attached together via a central portion 2821. In the illustrated example, the central portion 2821 and wedge blocks 2804 are integrally formed. In other examples, they may be separate pieces that can be attached together. The central portion 2821 includes two ball nuts 2808 for engagement with ball screws 2820. Rotation of the ball screws 2820 results in linear translation of the wedge-shaped cam member 2802.

The follower block 2810 includes a number of flat walls 2825 and recesses 2830 configured for receiving at least a portion of at least one flange 2304 of the transverse bowl engagement member 2300. Each recess 2830 is at least partially bounded on one side by a convex wall 2813. Each flat wall 2825 of the follower block 2810 is in contact with and rests against a surface of the guide plate 2293. The movement of the follower block 2810 is confined by the guide plates 2293. In other words, the guide plates 2293 define a track for the follower block 2810. The follower block 2810 can slide upwardly or downwardly against the surfaces of the guide plates 2293. However, the guide plates 2293 impedes lateral movement of the follower block 2810, i.e. movement in forward direction towards the front portion 2219 of the bowl assembly 2200, at least to a certain degree. The follower block 2810 is preferably configured such that the convex wall 2813 always remains in contact with at least a portion of the at least one flange 2304, regardless of the position of the follower block 2810 within its track. The follower block 2810 also includes a slanted bottom face 2811 configured for contacting the wedge blocks 2804.

Figure 60:
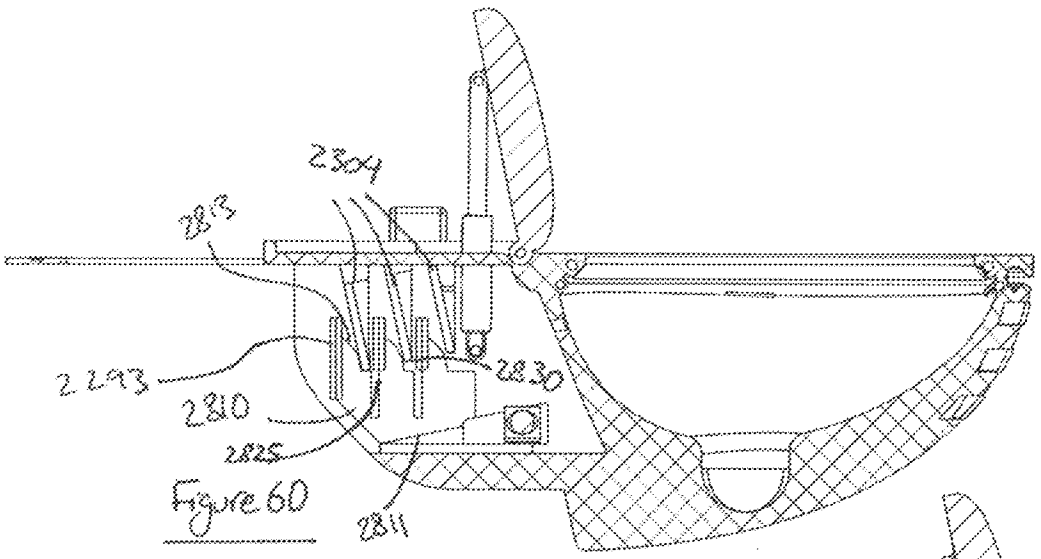
FIG. 60 is a cross section view of the bowl assembly of FIG. 56 in a tilted orientation.
Figure 61:
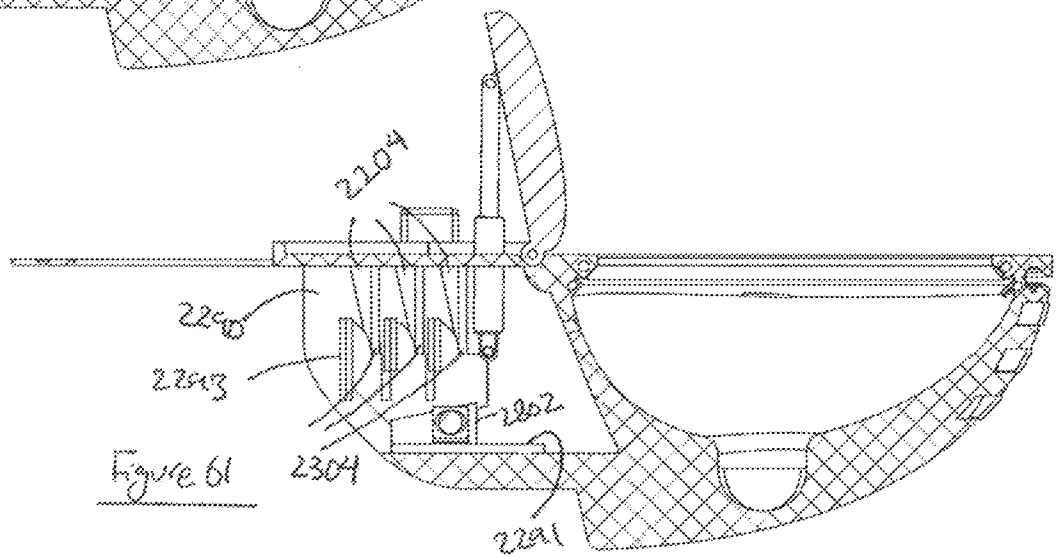
FIG. 61 is a cross section view of the bowl assembly of FIG. 56 in a horizontal orientation.

When the wedge blocks 2804 are underneath the slanted bottom face 2811, the bowl assembly 2200 is not titled. This can be seen in FIG. 61. To tilt the bowl assembly 2200, the drive member 2800 slides the wedge-shaped cam member in a forward direction away from the follower block 2810. That is, the wedge blocks 2804 are moved out of the space at least partially defined by the slanted bottom face 2811 and bottom plate 2291 of the cavity 2290. This is illustrated in FIG. 60.

When the wedge-shaped cam member 2802 moves away from the follower block 2810, the follower block 2810 slides generally downwardly against the guide plates 2293, i.e. moves downwardly in its track. As discussed, the follower block 2810 is preferably configured such that at least a portion of the at least one of the flanges 2304 remains in contact with one convex wall 2813 regardless of the position of the follower block 2810 relative to guide plates 2293. Accordingly, when the follower block 2810 slides downwardly, a portion of the convex wall that wants to remain in contact with the flange 2304 exerts a forward force on the flange 2304, i.e. pushes the flange in a forward direction. This is at least in part due to convexity of the convex wall 2813 and guide plates 2293 impeding lateral movement of the follower block 2810.

However, as the flange 2304 is connected to actuator 2400 and the actuator 2400 is fixed relative to the frame 2100, flange 2304 generally maintains their orientation, i.e. face 2307 of the flange 2304 (as best can be seen in FIG. 43) remains generally parallel with the floor, or bottom plate 2125. In other words, the exerted forward force does not move the flange 2304. As a result, the flange 2304 exerts a reactive force in an opposite direction to the convex wall 2813, i.e. pushes the convex wall rearwardly towards rear portion 2209 of the bowl assembly 2200. Since the follower block rests against guide plates 2293, the reactive force cannot laterally move the follower block 2810 towards the rear portion 2209 of the bowl assembly 2200. As the guide plate is connected to the bowl assembly 2200, this reactive force is transferred to the bowl assembly 2200. The transferred force results in a moment at a longitudinal axis of the bore 2256, i.e. where the bowl assembly is fastened to the forward-facing bowl engagement member 2350. This moment causes the bowl assembly 2200 to pivot about this axis, i.e. to tilt forwardly.

In the illustrated example, since the wedge block 2804 can be fully underneath the follower block 2810, fully away from the follower block 2810 or in any intermediate position, the tilt angle of the bowl assembly 2200 can be adjusted.

It will be appreciated that some of the embodiments disclosed herein may not use any of the features of the tilting bowl disclosed herein and that, in those embodiments, a tilting bowl may not be provided.

Retractable Handles

The following is a description of retractable handles that may be used by itself in any toilet, including toilet 1000 and/or 2000, or in any combination or sub-combination with any other feature or features disclosed herein including a slideable electric coupling, a tilting bowl assembly, a retractable bidet, a linear retractable bidet, a motorized toilet seat, and/or a seat cleaner.

In accordance with this feature, a pair of handles may be deployed or retracted using one or more handle actuators. For example, the handles may be deployed and/or retracted upon request by, e.g., a user pushing a button, and/or automatically depending on e.g. the vertical position of bowl assembly 2200.

As exemplified in FIGS. 29 to 32, 35, 36, 45 and 46, a retractable handle assembly, referred to generally as 2600, is provided in a handle recess 2166 located in each of front supports 2104, 2105. The handle assembly includes a handle 2606 and a linear actuator, e.g., a ball-screw type linear actuator. The linear actuator includes a motor 2602, a ball screw 2604 attached to the motor's shaft, and a ball nut 2608 secured to the handle 2606. As the motor 2602, and thus the ball screw 2404, rotates the ball nut 2608, and thus the attached handle 2606, translates along the length of the ball screw 2604. Thus, the handle 2606 extends out of or retracts into the recess 2166. FIG. 29 shows the handle 2606 in a retracted position.

In the illustrated example, handle assembly 2600 is supported on a handle support plate 2160 of the frame 2100. Handle support plate 2160 is located below the upper surface 2110 and above the blind roller 2130*a*. Handle support plate 2160 is secured to the rest of the frame 2100 through a plurality of posts 2162 running between the underside of upper surface 2110 and a top surface of the handle support plate 2160. The motor 2602 of the handle assembly 2600 is secured to bracket 2168 attached to the handle support plate 2160, such that the motor 2602 is fixed to and does not move relative to the frame 2100. A pair of bracket 2164 having cylindrical bores configured to receive handle 2606 are attached to the handle support plate 2160. Brackets 2164 are configured to guide linear translation of the handle 2606 into the recess 2166.

Similar to handle assembly 1600, the handle assembly 2600 may also include one or more manual controls positioned at an accessible end of the handle 2606 (not shown). For example, actuating these manual controls may generate a signal to actuate a bidet feature, extract or retract the handles, or to enable tilting of bowl assembly 2200.

It will be appreciated that some of the embodiments disclosed herein may not use any of the features of the retractable handles disclosed herein and that, in those embodiments, handles may not be provided, or any alternative handles known in the art may be used.

Linear Retractable Bidet

The following is a description of a bidet assembly that may be used by itself in any toilet, including toilet 1000 and/or 2000, or in any combination or sub-combination with any other feature or features disclosed herein including automatically deployable handles, retractable handles, a slideable electric coupling, a tilting bowl assembly, a motorized toilet seat, and/or a seat cleaner.

As exemplified in FIGS. 29, 33, 34, 48 and 58, a bidet assembly, referred to generally as 2700, may optionally be provided within the bowl assembly 2200. Bidet assembly 2700 includes a conduit 2710 having a water inlet 2714 at one end and a plurality of water outlets 2712 provided on an upper surface of the other end of the conduit 2710. In use, water is selectively introduced through inlet 2714 under sufficient pressure to generate upwardly projecting water jets emanating from outlets 2712.

The bidet assembly 2700 includes a bracket 2702 for securing the bidet assembly 2700 to the bowl assembly 2200. The bracket 2702 may be secured to the bowl assembly 2200 by, e.g., fastening the bracket 2702 to an underside of surface 2287 of the bowl assembly 2200 through use of fasteners received by threaded bores 2716 of the bracket 2702.

The bracket 2702 is also configured for housing a motor 2704 and receiving a guide roller 2708. Shaft of the motor 2704 is connected to a pulley sheave 2706. The guide roller 2708 is rotatably mounted to the bracket 2702 on a location below where the shaft of the motor projects out of the bracket 2702. The guide roller 2708 can rotate freely about a guide roller mounting pin (not shown). The conduit 2710 passes between the guide roller 2708 and pulley sheave 2706. In other words, the conduit 2710 is sandwiched between the pulley sheave 2706 and guide roller 2708. As the motor 2704 rotates, the pulley sheave 2706 pushes the conduit 2710 forward/backward and thereby causes the conduit 2710 to extend out or retract into opening 2201 of the bowl 2220.

Similar to bidet assembly 1500, preferably, one or more heating elements (not shown) may be provided within conduit 2710. For example, an electric current may be applied to heating element to raise the temperature of water in conduit 2710.

It will be appreciated that some of the embodiments disclosed herein may not use any of the features of the linear retractable bidet assembly disclosed herein and that, in those embodiments, a bidet assembly may not be provided, or any alternative bidet assembly known in the art may be used.

Seat Cleaner

The following is a description of a seat cleaner that may be used by itself in any toilet, including toilet 1000 and/or toilet 2000, or in any combination or sub-combination with any other feature or features disclosed herein including automatically deployable handles, retractable handles, a slideable electric coupling, a tilting bowl assembly, a retractable bidet, and/or a linear retractable bidet.

As exemplified in FIGS. 29, 32, 50 to 52, 56, and 57, a toilet seat, referred to generally as 2900, may optionally include a seat cleaner 2904. Seat cleaner 2904 includes a steam conduit 2910 housed in a housing 2909. The steam conduit 2910 includes an inlet end 2912 and an outlet end 2916. Seat cleaner also includes a pair of wheels 2930 pivotably mounted to the housing 2909 in the proximity of the inlet end 2912.

Seat cleaner 2904 runs on a belt-driven track around the outer perimeter 2906 of the seat 2900. The belt-driven track includes the seat cleaner rear track portion 2223, a motor 2224, a drive pulley 2225, a plurality of idler pulleys 2226, a seat cleaner front track portion 2905 and an endless belt or traction band (not shown). The motor 2224 is mounted on the seat cleaner rear track portion 2223. A drive pulley 2225 is attached to and rotated with a shaft of the motor 2224. The plurality of idler pulleys 2226 are arranged around and rotatably mounted to a region in the proximity of the outer perimeter 2227 of the seat cleaner rear track portion 2223. The endless belt or traction band is wrapped around the drive pulley 2225 and seat cleaner front track portion 2905, and it is supported by the plurality of idler pulleys 2226. Wheels 2930 of the seat cleaner 2904 are received by the seat cleaner front track portion 2905 so that the seat cleaner 2904 can be guided and follow the path defined by the front track portion 2905. When the motor 2224 rotates, the endless belt slides on the front track portion 2905 and carry the seat cleaner 2904 around the front track portion 2905, similar to a conveyor belt system.

Inlet end 2912 of the seat cleaner 2904 is in fluid communication via a flexible hose (not shown) with a steam generator 2908. Steam generator 2908 is in fluid communication with a water reservoir (not shown) to receive water and turn the water into steam. The steam generator 2908 may for example use a heating element to heat the water into steam. The steam enters the steam conduit 2910 through inlet 2913 of the inlet end 2912 after e.g. a solenoid valve (not shown) between the steam generator 2908 and inlet end 2912 opens. The steam exits the steam conduit 2910 through a plurality of steam nozzles 2918 in the outlet end 2916 and is sprayed on the surface 2901 of the seat 2900. The steam may clean and/or disinfect the surface 2901. The steam emanated from the nozzles 2918 may enter the bowl 2220 through optional perforations 2902 of the seat 2900 and internal ducting (not shown) located below the perforations 2902. Debris on the surface 2901 of the seat 2900 may also pass through the perforations 2902 into the bowl 2220 as a result of being dislodged by and/or carried by the steam (and/or water condensed from the steam). Thereafter, the steam (and/or water condensed from the steam) and debris can be expelled from the bowl by initiating a flush cycle, as described above.

After the seat cleaner 2904 travels from first end 2920 to second end 2922 of the seat 2900, the motor 2224 may be reversed to move the seat cleaner 2904 back to the first end 2920. During its return, the seat cleaner 2904 may continue spraying steam onto the surface 2901 of the seat 2900.

Alternatively, or additionally, one or more UV light emitters may be provided at the outlet end 2916 of the seat cleaner 2904 to assist in disinfection of surface 2901.

It will be appreciated that some of the embodiments disclosed herein may not use any of the features of the seat cleaner disclosed herein and that, in those embodiments, the toilet seat may be of various constructions and that in those embodiments any toilet seat known in the art may be used.

Rotatable Floor Mount Assembly

The following is a description of a rotatable floor mount assembly that may be used by itself in any toilet or in any combination or sub-combination with any other feature or features disclosed herein including automatically deployable handles, a slideable electric coupling, a tilting bowl assembly, and/or a retractable bidet.

Turning to FIGS. 31, 32, and 38 to 41, a rotatable floor mount assembly may be provided for rotating the toilet 2000, including both the frame 2100 and bowl assembly 2200, about a vertical axis, e.g., by 45 degrees in both clockwise and counter clockwise directions. The rotatable floor mount assembly includes a motor 2170. The motor 2170 is secured to bottom plate 2125 such that its shaft is vertically oriented and faces a floor on which the toilet is mounted. A drive gear 2171 is secured to the shaft of the motor 2170 and rotates along with the shaft. The floor mount assembly further includes a planar thrust roller bearing 2178 secured to bottom surface 2127 of the bottom plate 2125. Before securing the base 2102 to bottom plate 2125 through use of mechanical fasteners passing through hollowed posts 2126, a portion of the floor mount assembly may be placed between the bottom plate 2125 and base 2102.

The floor mount assembly also includes a closet flange 2177, an upper drain ring 2175, a bearing 2176, and a cap 2173. The closet flange 2177 is configured for insertion into a drain cavity of the floor the toilet 2000 is mounted on. The closet flange 2177 is secured to the floor and does not rotate relative to the floor. The upper drain ring 2175 sits atop the closet flange and is secured to the closet flange. The bearing 2176 sits on an annular ridge located near an inner perimeter of the upper drain ring 2175 (as best seen in FIG. 39) and is configured such that a portion of a waste conduit, such as waste conduit 2230 (discussed in more detail below), passing through the upper drain ring 2175 can bear against the bearing 2176 during rotation of the toilet 2000. The cap 2173 is located on top of the upper drain ring 2175 and is secured to the floor via mechanical fasteners, such as bolts, passing through apertures 2181, and is fixed relative to the floor.

The cap 2173 of the floor mount assembly is sandwiched between the bottom plate 2125 and base 2102, as discussed above. During rotation of the toilet 2000, cap 2173 bears against the planar thrust roller bearing 2178. To enable the rotation of the toilet 2000, a portion of an outer perimeter of cap 2173 includes gear teeth 2172 for engagement with drive gear 2171. In the illustrated example, toothed portion 2172 is an integral part of the cap 2173. In other examples, a gear may be affixed to the cap 2173. To rotate the toilet 2000, the motor 2170 may be activated. As teeth 2172 are stationary relative to the floor, engagement of the drive gear 2171 with teeth 2172 causes the drive gear 2171 to orbit or revolve around the toothed outer perimeter of fixed cap 2173. As the drive gear is fixed in relation to the motor 2170, and the motor is secured to the frame 2100, the frame 2100, and as a result the toilet 2000, rotates about the vertical axis.

Facilitating the rotation of toilet 2000 may have one or more advantages. For example, the toilet may be rotated to a more convenient position for persons with limited mobility (e.g. the elderly, overweight persons, persons with disabilities, persons using a wheelchair) to mount and/or dismount the toilet. Also, if a caregiver or attendant (e.g. a nurse) is assisting a person using the toilet, the ability to rotate the toilet may provide more room for the caregiver to position themselves to assist in lifting or otherwise supporting the person using the toilet. Additionally, or alternatively, it may allow toilet 2000 to be installed in a position where the bowl may be relatively close to a wall or other structure, as the toilet may be rotated so that the bowl moves away from such a wall/structure, the toilet used, and then rotated back to its initial position. This may allow toilet 2000 to be installed in a relatively small area.

It will be appreciated that some of the embodiments disclosed herein may not use any of the features of the rotatable floor mount assembly disclosed herein and that, in those embodiments, a rotatable floor mount assembly may not be provided.

Adjustable Backrest

The following is a description of an adjustable backrest that may be used by itself in any toilet or in any combination or sub-combination with any other feature or features disclosed herein including automatically deployable handles, a slideable electric coupling, a tilting bowl assembly, and/or a retractable bidet.

Referring to FIGS. 33, 34 and 58, in the illustrated example, the bowl assembly 2200 includes a backrest 2280. The user can rest his/her back against the backrest 2280 while sitting on toilet seat 2900. Optionally, the backrest 2280 is configured to assist users having difficulty in dismounting the toilet seat by pushing them in the forward direction, i.e. towards the front portion 2219 of the bowl assembly 2200, through exerting some force on users' back. For example, lower portion 2288 of the backrest 2280 may be pivotably secured to the bowl assembly 2200 through, e.g., positioning a mechanical fastener, such as a bolt, into bore 2282 of the bowl assembly 2200 and a corresponding bore (not shown) in the lower portion 2288 of the backrest 2280.

Figure 54:
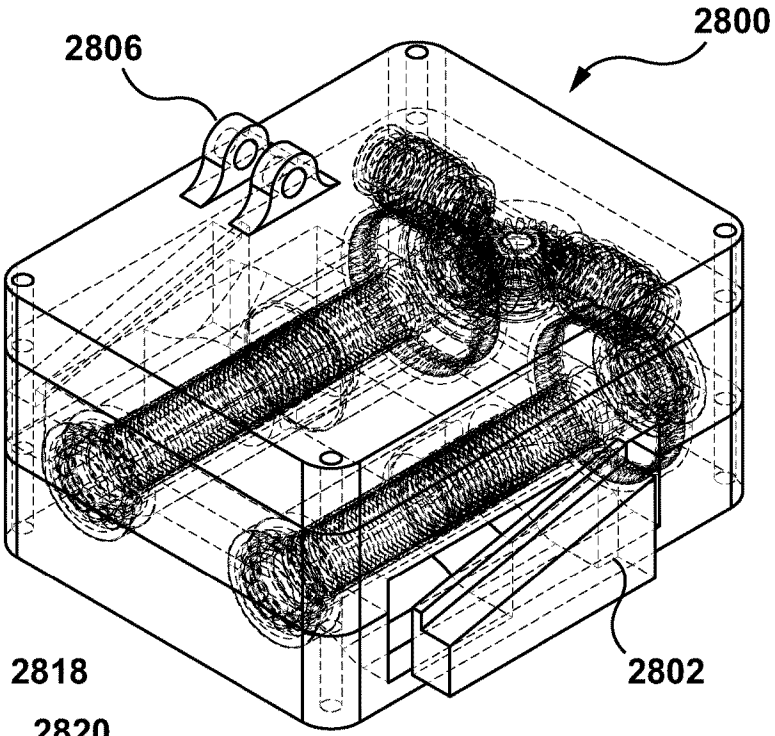
FIG. 54 is a transparent perspective view of a drive member of the tilting bowl assembly, employing the wedge-shaped cam member of FIG. 53.
Figure 53:
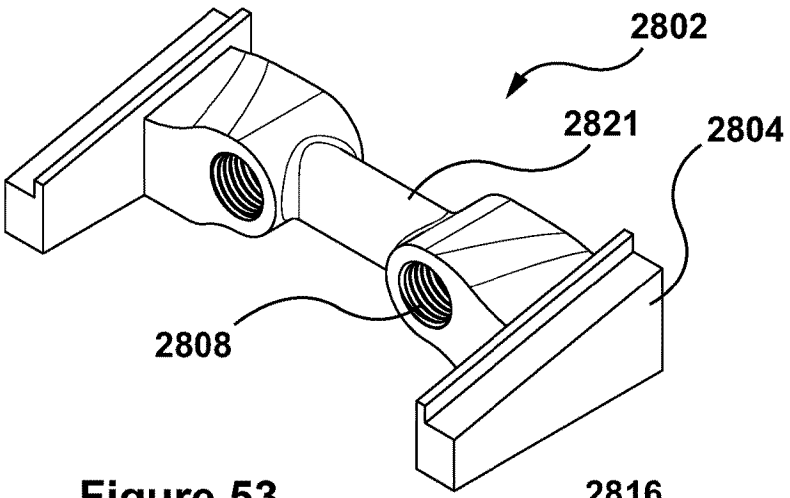
FIG. 53 is a perspective view of a wedge-shaped cam member of a tilting bowl assembly of the adjustable height toilet of FIG. 29.
Figure 55:
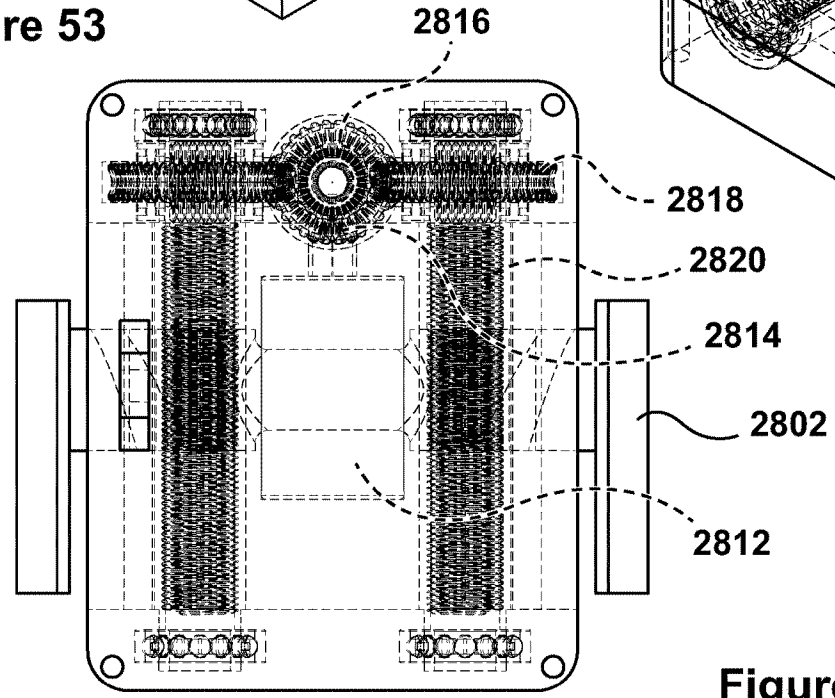
FIG. 55 is a transparent top view of the drive member of FIG. 54.

Optionally, an actuator 2286 (e.g. a linear actuator, such as a hydraulic cylinder, a pneumatic cylinder, an electric linear actuator, and the like) may be pivotably secured from its first end 2284 to upper portion 2289 of the backrest 2280 and from its second end 2285 to a mounting flange 2806 located on top of a drive member 2800 for tilting the bowl assembly 2200 (as best shown in FIG. 54 and discussed in more detail below). In the illustrated arrangement, backrest 2280 can be retracted from its relatively upright position into a relatively horizontal position and be received on surface 2287 of the bowl assembly 2200. The backrest 2280 may also be adjustable by the linear actuator to one or more angles relative to the toilet seat 2900. This way, the user can adjust the backrest 2280 to a comfortable position, or if having difficulty in standing up, to a position that the backrest can push out the user and help him/her in dismounting.

It will be appreciated that some of the embodiments disclosed herein may not use an adjustable backrest.

Referring to FIG. 56, the bowl assembly 2200 may optionally include a number of lighting elements 2260 for illuminating an area located in front of the bowl assembly 2200. Alternatively, elements 2260 may be buttons or sensors for raising or lowering the bowl assembly 2200, tilting the bowl assembly 2200, retracting or adjusting the backrest 2280, retracting or extending the bidet assembly 2700, activating the sear cleaner 2904, activating the flush cycle, and/or retracting or extending the handle assembly 2600.

As used herein, the wording "and/or" is intended to represent an inclusive—or. That is, "X and/or Y" is intended to mean X or Y or both, for example. As a further example, "X, Y, and/or Z" is intended to mean X or Y or Z or any combination thereof.

While the above description describes features of example embodiments, it will be appreciated that some features and/or functions of the described embodiments are susceptible to modification without departing from the spirit and principles of operation of the described embodiments. For example, the various characteristics which are described by means of the represented embodiments or examples may be selectively combined with each other. Accordingly, what has been described above is intended to be illustrative of the claimed concept and non-limiting. It will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. An adjustable height toilet comprising:

a frame;

a bowl assembly, wherein the bowl assembly comprises a waste conduit having an inlet end, an outlet end, and an intermediate portion;

at least one bowl assembly actuator;

wherein the at least one bowl assembly actuator is configured to translate the bowl assembly vertically with respect to the frame between a lower position and an upper position, wherein the toilet has an overall height that remains constant as the bowl assembly is translated between the lower position and the upper position; and a vacuum flush system, wherein the vacuum flush system comprises:

a vacuum control valve in fluid communication with the intermediate portion of the waste conduit;

a low pressure chamber in fluid communication with the vacuum control valve and with the outlet end of the waste conduit, the low pressure chamber including a first slidable sidewall having an inlet, the lower pressure chamber being in fluid communication with the intermediate portion of the waste conduit via the inlet, the first slidable sidewall providing for the low pressure chamber to remain in fluid communication with the intermediate portion of the waste conduit via the inlet during vertical movement of the bowl assembly with respect to the frame;

a high pressure chamber in fluid communication with the low pressure chamber; and a pneumatic drain valve in fluid communication with the waste conduit.

2. The adjustable height toilet of claim 1, further comprising a rotational base assembly for securing the frame to a floor surface, wherein the rotational base assembly is configured to rotate the frame about a vertical axis through a range of at least 30 degrees.

3. The adjustable height toilet of claim 2, wherein the range is a range of 90 degrees.

4. The adjustable height toilet of claim 1, wherein the bowl assembly comprises a seat portion, the seat portion having an upper surface and a plurality of fluid conduits extending between the upper surface of the seat portion and a fluid outlet.

5. The adjustable height toilet of claim 4, wherein the bowl assembly further comprises a seat cleaner and a seat cleaner actuator configured to move the seat cleaner along a length of the seat portion.

6. The adjustable height toilet of claim 5, wherein the seat cleaner is configured to direct at least one of steam, water, and a disinfectant fluid towards the upper surface of the seat portion.

7. The adjustable height toilet of claim 5, wherein the seat cleaner comprises at least one UV light emitter configured to direct UV light towards the upper surface of the seat portion.

8. The adjustable height toilet of claim 1, wherein the at least one bowl assembly actuator comprises a pair of linear actuators.

9. The adjustable height toilet of claim 1, further comprising a retractable bidet positioned in the bowl assembly.

* * * * *